US009145632B2

(12) United States Patent
Matsushima

(10) Patent No.: US 9,145,632 B2
(45) Date of Patent: Sep. 29, 2015

(54) SEWING MACHINE AND NON-TRANSITORY COMPUTER-READABLE MEDIUM

(71) Applicant: Mika Matsushima, Ichinomiya (JP)

(72) Inventor: Mika Matsushima, Ichinomiya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 104 days.

(21) Appl. No.: 14/136,521

(22) Filed: Dec. 20, 2013

(65) Prior Publication Data

US 2014/0182499 A1 Jul. 3, 2014

(30) Foreign Application Priority Data

Dec. 27, 2012 (JP) ..... 2012-285018

(51) Int. Cl.
*D05B 19/08* (2006.01)
*D05B 19/12* (2006.01)

(52) U.S. Cl.
CPC ..... *D05B 19/12* (2013.01); *D05B 19/08* (2013.01)

(58) Field of Classification Search
CPC ..... D05B 19/08; D05B 19/12; D05B 19/02; D05B 19/10
USPC ..... 700/136–138; 112/475.18, 475.19, 112/470.01, 470.04, 470.06, 102.5
See application file for complete search history.

(56) References Cited

U.S. PATENT DOCUMENTS 3,966,331 A * 6/1976 Inuiya ..... 356/391
4,998,489 A * 3/1991 Hisatake et al. ..... 700/138
7,848,842 B2 12/2010 Suzuki et al.
7,971,543 B2 7/2011 Nagai et al.
8,463,420 B2 6/2013 Tokura
8,528,491 B2 * 9/2013 Bentley ..... 112/470.04
8,805,568 B2 * 8/2014 Maki ..... 700/137
8,904,947 B2 * 12/2014 Nishimura et al. ..... 700/138
9,014,838 B2 * 4/2015 Muto ..... 700/137
2006/0027153 A1 2/2006 Hirata et al.
2008/0264318 A1 10/2008 Mori
2009/0272305 A1 * 11/2009 Tseng ..... 112/470.04
2014/0000498 A1 * 1/2014 Yamanashi et al. ..... 700/138
2014/0090587 A1 * 4/2014 Ichiyanagi et al. ..... 700/137
2014/0182499 A1 * 7/2014 Matsushima ..... 700/137
2014/0290551 A1 * 10/2014 Jimbo et al. ..... 112/470.06

FOREIGN PATENT DOCUMENTS

JP A-2006-43231 2/2006
JP A-2008-272045 11/2008
JP A-2011-194043 10/2011

* cited by examiner

*Primary Examiner* — Danny Worrell
(74) *Attorney, Agent, or Firm* — Oliff PLC

(57) ABSTRACT

The sewing machine includes a needle bar, a needle bar mechanism, a moving mechanism, a projector, a processor, and a memory. The memory is configured to store computer-readable instructions that, when executed by the processor, instruct the processor to perform processes comprising specifying, a plurality of times, a position of an ultrasonic wave transmission source on a workpiece based on ultrasonic waves, setting a first stitch pattern and a sewing position of the first stitch pattern, based on a plurality of specified positions, causing the projector to project an image that shows the first stitch pattern onto the workpiece in the sewing position, creating first stitch pattern data for sewing the first stitch pattern in the sewing position, and causing, based on the first stitch pattern data, the moving mechanism to move the workpiece and the needle bar mechanism to move the needle up and down.

14 Claims, 13 Drawing Sheets

SEWING MACHINE AND NON-TRANSITORY COMPUTER-READABLE MEDIUM

CROSS-REFERENCE TO RELATED APPLICATION

This application claims priority to Japanese Patent Application No. 2012-285018 filed Dec. 27, 2012, the content of which is hereby incorporated herein by reference in its entirety.

BACKGROUND

The present disclosure relates to a sewing machine that is configured to sew a stitch pattern and to a non-transitory computer-readable medium.

A sewing machine is known that is configured to create data for sewing a stitch pattern in a sewing workpiece based on a user's commands. With the known sewing machine, the user inputs the shape of a desired stitch pattern by using a stylus pen to perform an operation of pressing a touch panel. The sewing machine displays the input stitch pattern shape on a liquid crystal display. Based on the shape of the input stitch pattern, the sewing machine automatically creates the data for forming the stitch pattern.

SUMMARY

With the sewing machine that is described above, the user has to manually perform the positioning of the stitch pattern in relation to the sewing workpiece, which is cumbersome.

Embodiments of the broad principles derived herein provide a sewing machine that is capable of forming a stitch pattern of a desired shape in a desired position on the sewing workpiece by a simple operation. The embodiments also provide a non-transitory computer-readable medium.

Embodiments provide a sewing machine that includes a needle bar, a needle bar mechanism, a moving mechanism, a projector, a processor, and a memory. The needle bar is configured to be mounted with a sewing needle. The needle bar mechanism is configured to move the needle bar up and down. The moving mechanism is configured to move a workpiece to be sewn. The memory is configured to store computer-readable instructions that, when executed by the processor, instruct the processor to perform processes comprising specifying, a plurality of times, a position of an ultrasonic wave transmission source on the workpiece, based on ultrasonic waves detected by an ultrasonic wave detection device, setting a first stitch pattern and a sewing position of the first stitch pattern on the workpiece, based on a plurality of specified positions of the ultrasonic wave transmission source acquired by the specifying of the position the plurality of times, the first stitch pattern being a stitch pattern, causing the projector to project an image that shows the first stitch pattern onto the workpiece in the sewing position, creating first stitch pattern data for sewing the first stitch pattern in the sewing position, based on at least the first stitch pattern and the sewing position, and causing, based on the created first stitch pattern data, the moving mechanism to move the workpiece and the needle bar mechanism to move the needle bar up and down.

Embodiments further provide a non-transitory computer-readable medium storing comprising computer-readable instructions. The computer-readable instructions, when executed, instruct a processor of a sewing machine to perform processes including specifying, a plurality of times, a position of an ultrasonic wave transmission source on a workpiece to be sewn, based on ultrasonic waves detected by an ultrasonic wave detection device, setting a first stitch pattern and a sewing position of the first stitch pattern on the workpiece, based on a plurality of specified positions of the ultrasonic wave transmission source acquired by the specifying of the position the plurality of times, the first stitch pattern being a stitch pattern, causing a projector of the sewing machine to project an image that shows the first stitch pattern onto the workpiece in the sewing position, creating first stitch pattern data for sewing the first stitch pattern in the sewing position, based on at least the first stitch pattern and the sewing position, and causing, based on the created first stitch pattern data, a moving mechanism of the sewing machine to move the workpiece and a needle bar mechanism of the sewing machine to move the needle bar up and down.

BRIEF DESCRIPTION OF THE DRAWINGS

Embodiments will be described below in detail with reference to the accompanying drawings in which.

DETAILED DESCRIPTION

Hereinafter, embodiments will be explained with reference to the drawings.

Figure 1:
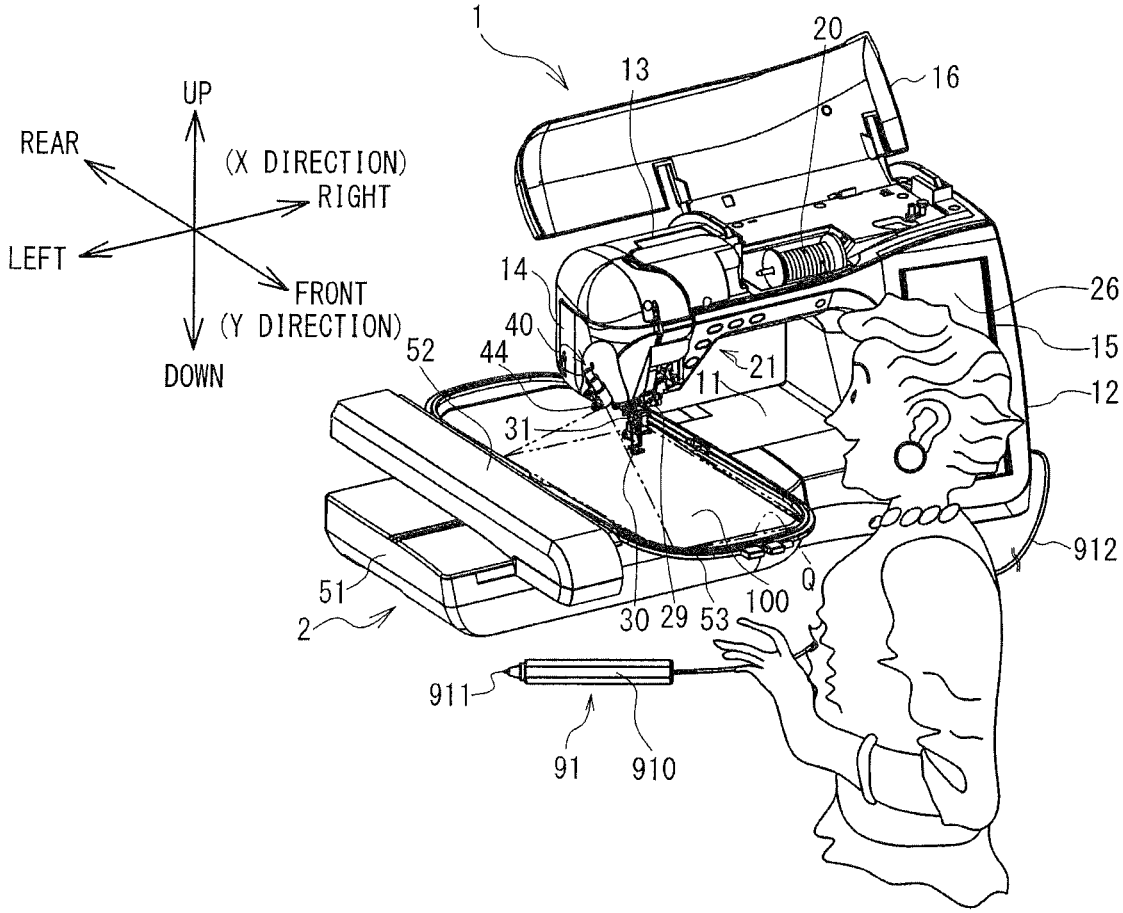
FIG. 1 is an oblique view of a sewing machine.
Figure 2:
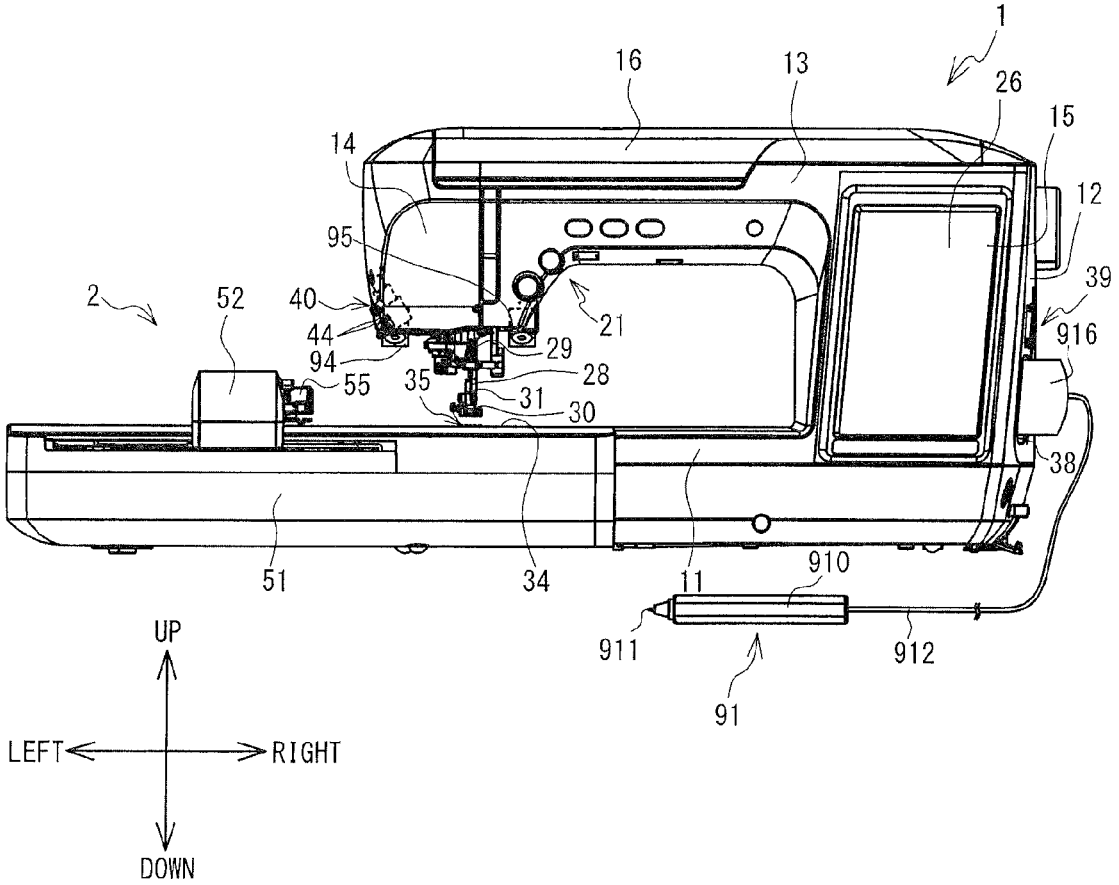
FIG. 2 is a front view of the sewing machine.

A physical configuration of a sewing machine 1 will be explained with reference to FIGS. 1 to 5. The upper side, the lower side, the lower left side, the upper right side, the upper left side and the lower right side of FIG. 2 are respectively defined as the upper side, the lower side, the left side, the right side, the rear side, and the front side of the sewing machine 1.

Figure 6:
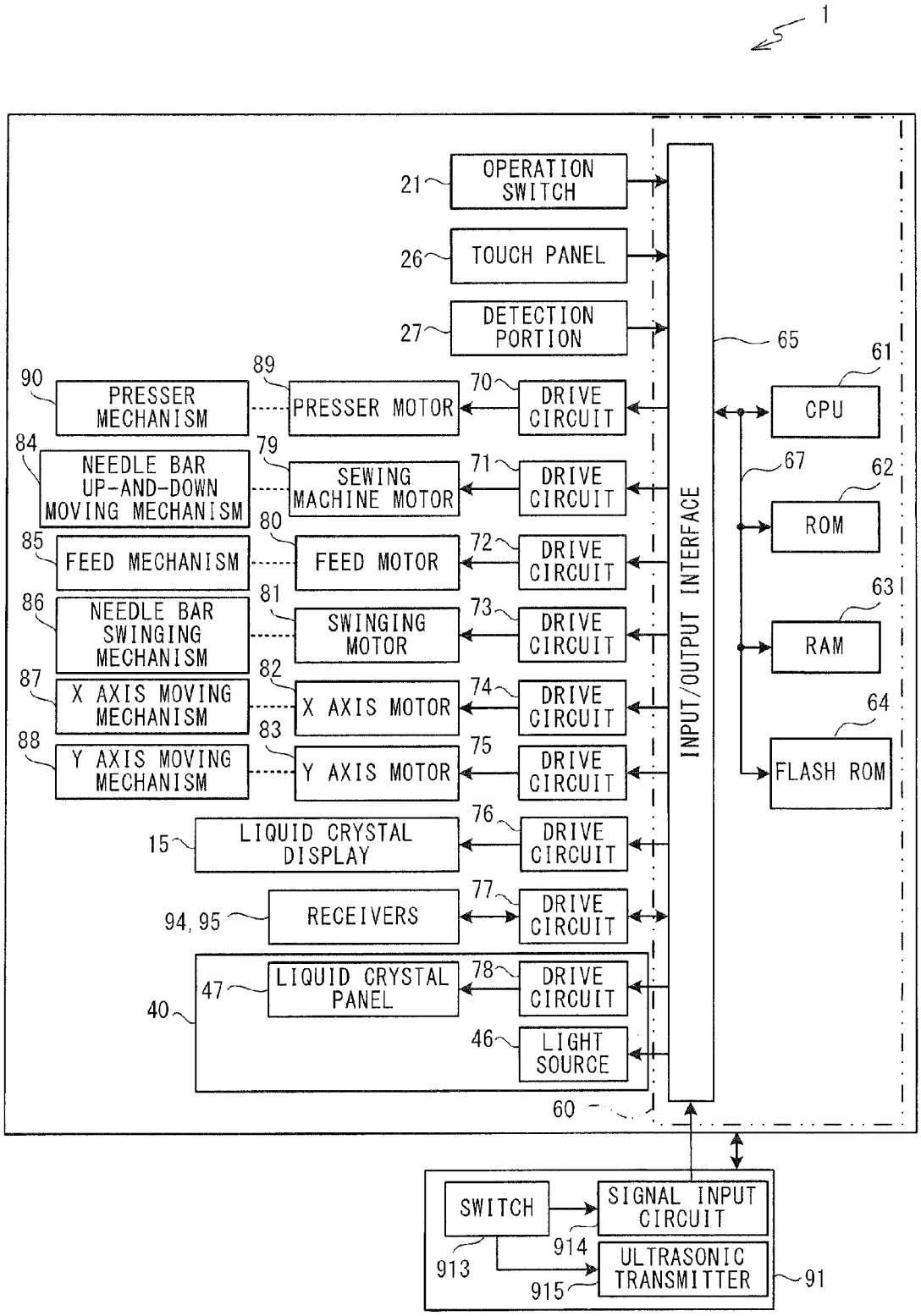
FIG. 6 is a block diagram that shows electrical configurations of the sewing machine and an ultrasonic pen.

The sewing machine 1 includes the bed 11, the pillar 12, and the arm 13. The bed 11 is a base portion of the sewing machine 1, and extends in the left-right direction. The pillar 12 extends upward from the right end of the bed 11. The arm 13 extends to the left from the upper end of the pillar 12 such that the arm 13 faces the bed 11. The left end of the arm 13 is a head 14. A needle plate 34 is disposed in the top face of the bed 11. A feed dog 35 (only the upper edge of which is shown in FIG. 2), a feed mechanism 85 (refer to FIG. 6), a feed motor 80 (refer to FIG. 6), and a shuttle mechanism (not shown in the drawings) are provided underneath the needle plate 34, that is, inside the bed 11. The feed dog 35 may be driven by the feed mechanism 85 and is configured to feed a sewing workpiece in a specified feed direction (one of the frontward direction and the rearward direction of the sewing machine 1). The sewing workpiece 39 may be a work cloth, for example. The feed mechanism 85 is a mechanism that is configured to move the feed dog 35 in the up-down direction and the front-rear direction. A bobbin around which a lower thread is wound can be accommodated within the shuttle mechanism. The shuttle mechanism is a mechanism that is configured to form a stitch in the sewing workpiece by operating in coordination with a sewing needle 28 that is mounted on a lower end of a needle bar 29, which will be described later. The feed motor 80 is a pulse motor for driving the feed mechanism 85.

A liquid crystal display (hereinafter called the LCD) 15 is provided on the front face of the pillar 12. An image that includes various types of items, such as commands, illustrations, setting values, messages, and the like, may be displayed on the LCD 15. A touch panel 26 that is configured to detect a position that is pressed is provided on the front face side of the LCD 15. When a user uses a finger or a stylus pen to perform a pressing operation on the touch panel 26, the position that is pressed is detected by the touch panel 26. Based on the pressed position that has been detected, the item that has been selected in the image is recognized. Hereinafter, the pressing operation that the user performs will be called a panel operation. The user is able to select a stitch pattern to be sewn or a command to be executed through the panel operation.

Connectors 38 and 39 are provided on the right side face of the pillar 12. A connector 916 can be connected to the connector 38. A cable 912 that extends from an ultrasonic pen 91 is connected to the connector 916. Through the connector 38, the connector 916, and the cable 912, the sewing machine 1 is able to supply electric power to the ultrasonic pen 91. The sewing machine 1 is also able to acquire electrical signals that are output from the ultrasonic pen 91. An external storage device (not shown in the drawings) such as a memory card or the like may be connected to the connector 39. The sewing machine 1 can acquire stitch data, as well as various types of programs, from the external storage device that is connected to the connector 39. The stitch data are data for forming the stitches that represent the stitch pattern.

A cover 16 that can be opened and closed is provided in the upper portion of the arm 13. In FIG. 1, the cover 16 is in an open state. In FIG. 2, the cover 16 is in an closed state. A spool 20 may be accommodated under the cover 16, that is, approximately in the central portion inside the arm 13. An upper thread (not shown in the drawings) that is wound around the spool 20 may be supplied from the spool 20, through a thread hook (not shown in the drawings) that is provided on the head 14, to the sewing needle 28 mounted on the needle bar 29. A plurality of operation switches 21 that include a start-and-stop switch are provided in the lower portion of the front face of the arm 13.

A presser mechanism 90 (refer to FIG. 6), a needle bar up-and-down moving mechanism 84 (refer to FIG. 6), a needle bar swinging mechanism 86 (refer to FIG. 6), and a swinging motor 81 (refer to FIG. 6), and the like are provided inside the head 14. The presser mechanism 90 is a mechanism that is configured to drive a presser bar 31 by using a presser motor 89 (refer to FIG. 6) as a driving source. The needle bar up-and-down moving mechanism 84 is a mechanism that is configured to move the needle bar 29 up and down in conjunction with the rotation of a drive shaft (not shown in the drawings). The needle bar up-and-down moving mechanism 84 may be driven by the sewing machine motor 79 refer to FIG. 6). The needle bar 29 and the presser bar 31 extend downward from the lower end of the head 14. The sewing needle 28 can be mounted on and removed from the lower end of the needle bar 29. A presser foot 30 can be mounted on and removed from the lower end of the presser bar 31. The presser foot 30 is configured to press the sewing workpiece 100 from above. The needle bar swinging mechanism 86 is a mechanism that is configured to swing the needle bar 29 in a direction (the left-right direction) that is orthogonal to the direction (the front-rear direction) in which the sewing workpiece 100 is fed by the feed dog 35. The swinging motor 81 is a pulse motor for driving the needle bar swinging mechanism 86.

Receivers 94 and 95 are provided on the rear portion of the lower end of the head 14. The receiver 94 and the receiver 95 have identical structures. The receiver 94 is provided on the rear portion at the lower left edge of the head 14. The receiver 95 is provided on the rear portion at the lower right edge of the head 14. The receivers 94 and 95 are separated from one another by the length of the head 14 in the left-right direction. The receivers 94 and 95 are devices that are configured to detect ultrasonic waves. The receivers 94 and 95 will be described in detail below.

A projector 40 that is configured to project an image onto the sewing workpiece 100 is attached to the left front portion of the head 14. The greater part of the projector 40 is contained in the interior of the head 14, but a pair of adjusting screws 44 project to the outside of the head 14, as shown in FIG. 2. The adjusting screws 44 are screws that may respectively adjust the size and the focal point of the image to be projected (hereinafter called the projection image). The projector 40 may project the image into a specified projection range Q on the bed 11. The projector 40 will be described in detail below.

The sewing machine 1 also includes an embroidery device 2. The embroidery device 2 can be mounted on and removed from the bed 11 of the sewing machine 1. When the embroidery device 2 is mounted on the sewing machine 1, the embroidery device 2 and the sewing machine 1 are electrically connected. In a case where the embroidery device 2 and the sewing machine 1 are electrically connected, the embroidery device 2 can move the sewing workpiece 100 held by an embroidery frame 53. The embroidery device 2 includes a body 51 and a carriage 52.

The carriage 52 is provided on the top side of the body 51. The carriage 52 has a rectangular shape that is long in the front-rear direction. The carriage 52 includes a frame holder 55, a Y axis moving mechanism 88 (refer to FIG. 6), and a Y axis motor 83 (refer to FIG. 6). The frame holder 55 is a holder on which the embroidery frame 53 (refer to FIG. 1) can be removably mounted. An embroidery frame of a size and shape that are different from those of the embroidery frame 53 can also be mounted on and removed from the frame holder 55. The frame holder 55 is provided on the right side face of the carriage 52. As shown in FIG. 1, the embroidery frame 53 has a known structure. The embroidery frame 53 is configured to hold the sewing workpiece 100 by clamping the sewing workpiece 100 between an inner frame and an outer frame, although this is not shown in detail in the drawings. The sewing workpiece 100 that is held by the embroidery frame 53 may be positioned on the top side of the bed 11 and below the needle bar 29 and the presser foot 30. The Y axis moving mechanism 88 is configured to move the frame holder 55 in the front-rear direction (the Y direction). The moving of the frame holder 55 in the front-rear direction causes the embroidery frame 53 to move the sewing workpiece 100 in the front-rear direction. The Y axis motor 83 may drive the Y axis moving mechanism 88. A CPU 61 (refer to FIG. 6) of the sewing machine 1 may control the Y axis motor 83 in accordance with coordinate data which will be described below.

An X axis moving mechanism 87 (refer to FIG. 6) that may move the carriage 52 in the left-right direction (the X direction) and an X axis motor 82 (refer to FIG. 6) are provided in the interior of the body 51. The moving of the carriage 52 in the left-right direction causes the embroidery frame 53 to move the sewing workpiece 100 in the left-right direction. The X axis motor 86 may drive the X axis moving mechanism. The CPU 61 of the sewing machine 1 may control the X axis motor 82 in accordance with coordinate data which will be described below.

In a case where a stitch is formed using the embroidery device 2, the embroidery frame 53 is moved by the Y axis moving mechanism 88 and the X axis moving mechanism 87 to a needle drop point that is indicated in an embroidery coordinate system that is particular to the sewing machine 1. The embroidery coordinate system is the coordinate system for the X axis motor 82 and the Y axis motor 83 that move the carriage 52. The needle drop point is the point where the sewing needle 28, which is positioned directly above a needle hole 32 (refer to FIG. 7), pierces the sewing workpiece 100 when the needle bar 29 is moved downward from above the sewing workpiece 100. The stitches that represent the stitch pattern are sewn in the sewing workpiece 100 by the operating of the shuttle mechanism (not shown in the drawings) and the needle bar 29 on which the sewing needle 28 is mounted, in coordination with the moving of the embroidery frame 53. The X axis motor 82, the Y axis motor 83, the needle bar 29, and the like are controlled by the CPU 61 of the sewing machine 1, based on the coordinate data that will be described below.

The ultrasonic pen 91 will be explained. The ultrasonic pen 91 includes a rod-shaped pen body 910 and a pen tip 911 that is provided on one end of the pen body 910. The pen tip 911 is ordinarily in a projecting position in which the pen tip 911 projects slightly to the outside of the pen body 910. When a force acts on the pen tip 911 in the direction toward the pen body 910, the pen tip 911 is pushed into the pen body 910. When the force that is acting on the pen tip 911 ceases, the pen tip 911 returns to the projecting position.

The ultrasonic pen 91 includes a switch 913 (refer to FIG. 6), a signal output circuit 914 (refer to FIG. 6), and an ultrasonic transmitter 915 (refer to FIG. 6) inside the pen body 910. When the pen tip 911 is in the projecting position, the switch 913 is in an OFF state. When the switch 913 is in the OFF state, the signal output circuit 914 does not output an electrical signal, and the ultrasonic transmitter 915 does not transmit ultrasonic waves. On the other hand, when the pen tip 911 is pressed and is pushed into the pen body 910, the switch 913 enters an ON state. When the switch 913 enters the ON state, the signal output circuit 914 outputs an electrical signal to the sewing machine 1 through the cable 912, and the ultrasonic transmitter 915 transmits ultrasonic waves. The ultrasonic pen 91 in the present embodiment does not leave a trace of ink or the like on the work cloth 100 even if the user presses the pen tip 911 against the sewing workpiece 100. Therefore, even if the user uses the ultrasonic pen 91 to input a command, no soiling of the sewing workpiece 100 occurs. The ultrasonic pen 91 may also include a fabric marking pen on the pen tip 911. In that case, ink from the fabric marking pen is drawn on the sewing workpiece 100 in the place where the user presses the pen tip 911 against the sewing workpiece 100.

As will be described in detail later, the sewing machine 1 is capable of detecting (receiving) the ultrasonic waves that are transmitted from the ultrasonic pen 91, using the receivers 94 and 95. The sewing machine 1 is able to identify the position of the transmission source of the ultrasonic waves, that is, the ultrasonic transmitter 915 that is provided in the ultrasonic pen 91, based on the detected ultrasonic waves. Based on the position that is specified based on the detected ultrasonic waves, the sewing machine 1 is able to set an edited stitch pattern and a sewing position of the edited stitch pattern. The edited stitch pattern is the stitch pattern to be formed in the sewing workpiece 100. Unlike existing stitch patterns that can be acquired through a ROM 62, a flash ROM 64, and the connector 39, the edited stitch pattern is a stitch pattern that is newly created based on a command that the user is input using the ultrasonic pen 91.

The receivers 94 and 95 will be explained with reference to FIGS. 3 and 4. The structure of the receiver 95 is identical to that of the receiver 94, so an explanation of the receiver 95 will be omitted. The up-down direction, the left-right direction, the front face side, and the rear face side in FIG. 3 are respectively the up-down direction, the left-right direction, the front side, and the rear side of the receiver 94.

Figure 3:
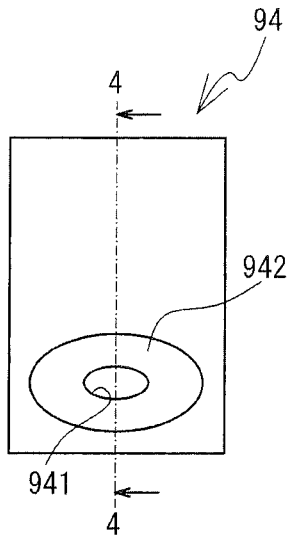
FIG. 3 is a front view of a receiver.
Figure 4:
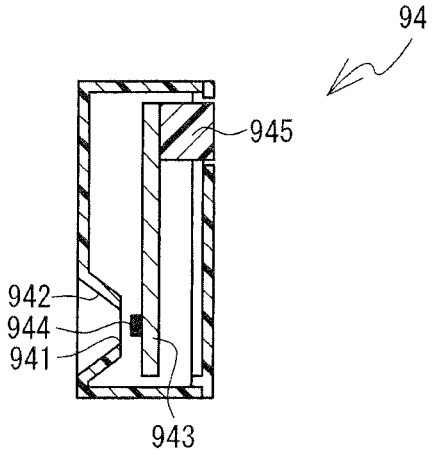
FIG. 4 is a section view of the receiver, as seen from the direction of arrows on a line 4-4 that is shown in FIG. 3.

As shown in FIGS. 3 and 4 the receiver 94 has a three-dimensional rectangular shape and has an elliptical opening 941 in the center of the lower portion of the front face. A surrounding portion 942 that surrounds the opening 941 is a tapered surface (an inclined surface) that makes the diameter become larger toward the front side. As shown in FIG. 4, an electrical circuit board 943 and a microphone 944 are provided in the interior of the receiver 94. The microphone 944 is positioned on the inner side of the opening 941. A connector 945 is mounted on the rear face of the upper end of the electrical circuit board 943. The connector 945 is connected to a connector (not shown in the drawings) that is provided in the sewing machine 1. The directionality of the receiver 94 may be determined by the orientation of the opening 941 in relation to the microphone 944.

Figure 5:
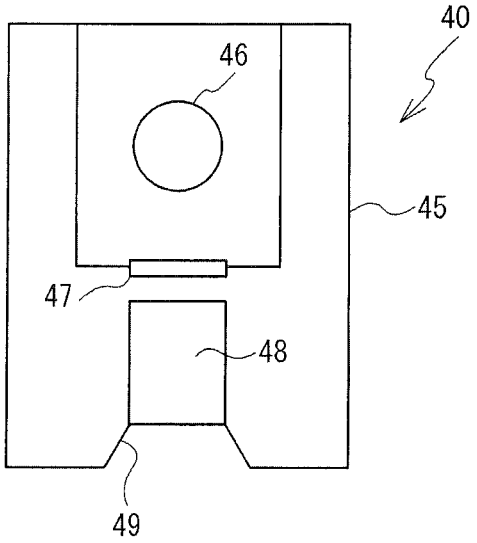
FIG. 5 is a schematic structural diagram of a projector.

The projector 40 will be explained with reference to FIG. 5. As shown in FIG. 5, the projector 40 includes a housing 45, a light source 46, a liquid crystal panel 47, and an image-forming lens 48. In the present embodiment, the housing 45 is formed into a cylindrical shape. The housing 45 is affixed to a machine casing within the head 14, oriented to face obliquely downward toward the right rear, with the area around a needle hole 32 (refer to FIG. 7) positioned on the axis line of the housing 45. A metal halide type of discharge lamp, for example, can be used as the light source 46. The liquid crystal panel 47 may modulate the light from the light source 46 and, based on image data that represent the projection image, may form an image beam for the image that is to be projected. The image-forming lens 48 may cause the image beam that has been formed by the liquid crystal panel 47 to form an image in the projection range Q (refer to FIG. 1) through a projection opening 49 that is provided in the housing 45. The projection range Q is set as desired, in accordance with the size of the embroidery frame 53 that is mounted on the embroidery device 2, for example. In FIG. 1, the left-right range of the projection range Q includes the left-right width of the embroidery frame 53. The front-rear range of the projection range Q includes the area from the front edge of the embroidery frame 53 to the positions where the receivers 94 and 95 are installed. In the present embodiment, the projector 40 is able to project the edited stitch pattern onto the sewing workpiece 100 at the sewing position of the edited stitch pattern. Because the projector 40 projects the projection image onto the sewing workpiece obliquely from above, processing is performed on the projection image to correct image distortion in the projection image, although this will not be explained in detail. A coordinate system for the projection image from the projector 40 and a coordinate system for the whole of space (hereinafter called the world coordinate system) are correlated to one another in advance. It is therefore possible to correct the image data for the projector 40 based on coordinates that are represented in the world coordinate system. In the present embodiment, the projection image is a color image in a plurality of colors. However, the projection image may also be an image in a single color, and it may also be possible for the color of the projection image to be adjusted according to the color of the sewing workpiece 100.

Figure 7:
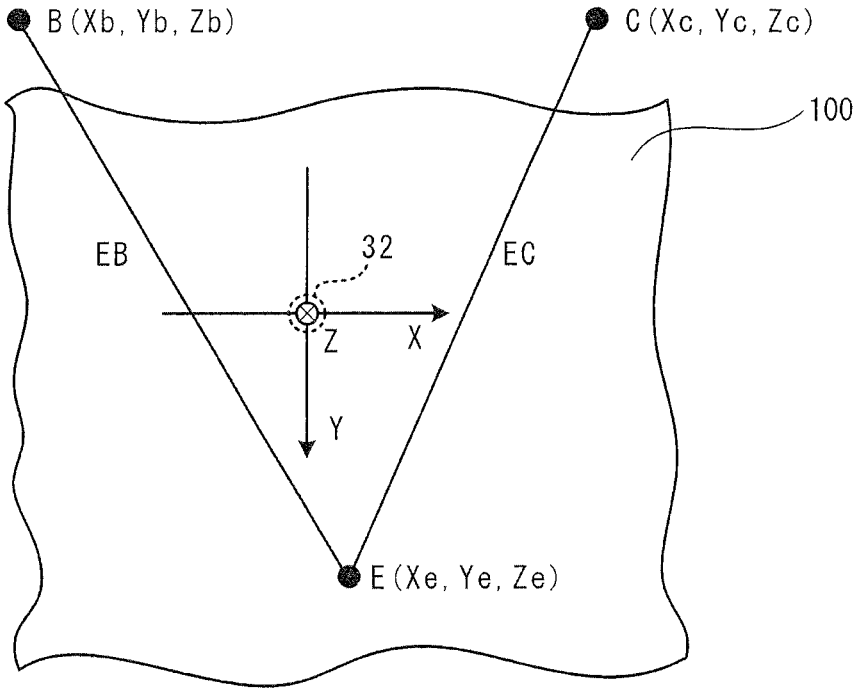
FIG. 7 is an explanatory figure of a method for identifying coordinates E that indicate a designated position.

An electrical configuration of the sewing machine 1 will be explained with reference to FIG. 7. A control portion 60 of the sewing machine 1 includes the CPU 61, a ROM 62, a RAM 63, a flash ROM 64, and an input/output interface 65. The CPU 61, the ROM 62, the RAM 63, the flash ROM 64, and the input/output interface 65 are electrically connected to one another through a bus 67. Various types of programs, including a program that the CPU 61 uses to perform main processing that will be described below, as well as data and the like, may be stored in the ROM 62. A sewing area table, a stitch type table, the stitch data, various types of parameters for creating the image data, and the like may be stored in the flash ROM 64. The sewing area table is a table in which the type of the embroidery frame 53 is stored in association with the size of a sewing area. The stitch type table is a table in which the type of a line that is included in the edited stitch pattern is stored in association with the type of stitches that form the line. The stitch type table will be described in detail later. The image data are data for the projecting of the projection image by the projector 40.

The operation switches 21, the touch panel 26, a detection portion 27, the light source 46, and drive circuits 70 to 78 are electrically connected to the input/output interface 65. The detection portion 27 is configured to detect whether or not the embroidery frame 53 has been mounted on the embroidery device 2 and also detect the type of the embroidery frame 53 that has been mounted on the embroidery device 2, then input the detected information to the CPU 61 through the input/output interface 65. The drive circuits 70 to 76 drive the presser motor 89, the sewing machine motor 79, the feed motor 80, the swinging motor 81, the X axis motor 82, the Y axis motor 83, and the LCD 15, respectively. The drive circuit 77 drives the receivers 94 and 95. The drive circuit 77 includes an amplifier circuit that amplifies the ultrasonic wave signals that have been detected by the receivers 94 and 95 and transmits them to the CPU 61. The drive circuit 78 drives the liquid crystal panel 47 of the projector 40.

The electrical configuration of the ultrasonic pen 91 will be explained. The ultrasonic pen 91 includes the switch 913, the signal output circuit 914, and the ultrasonic transmitter 915. The switch 913 is configured to be connected to the signal output circuit 914 and the ultrasonic transmitter 915. The signal output circuit 914 is connected to the input/output interface 65. The signal output circuit 914 may output electrical signals to the CPU 61 through the input/output interface 65.

Figure 8:
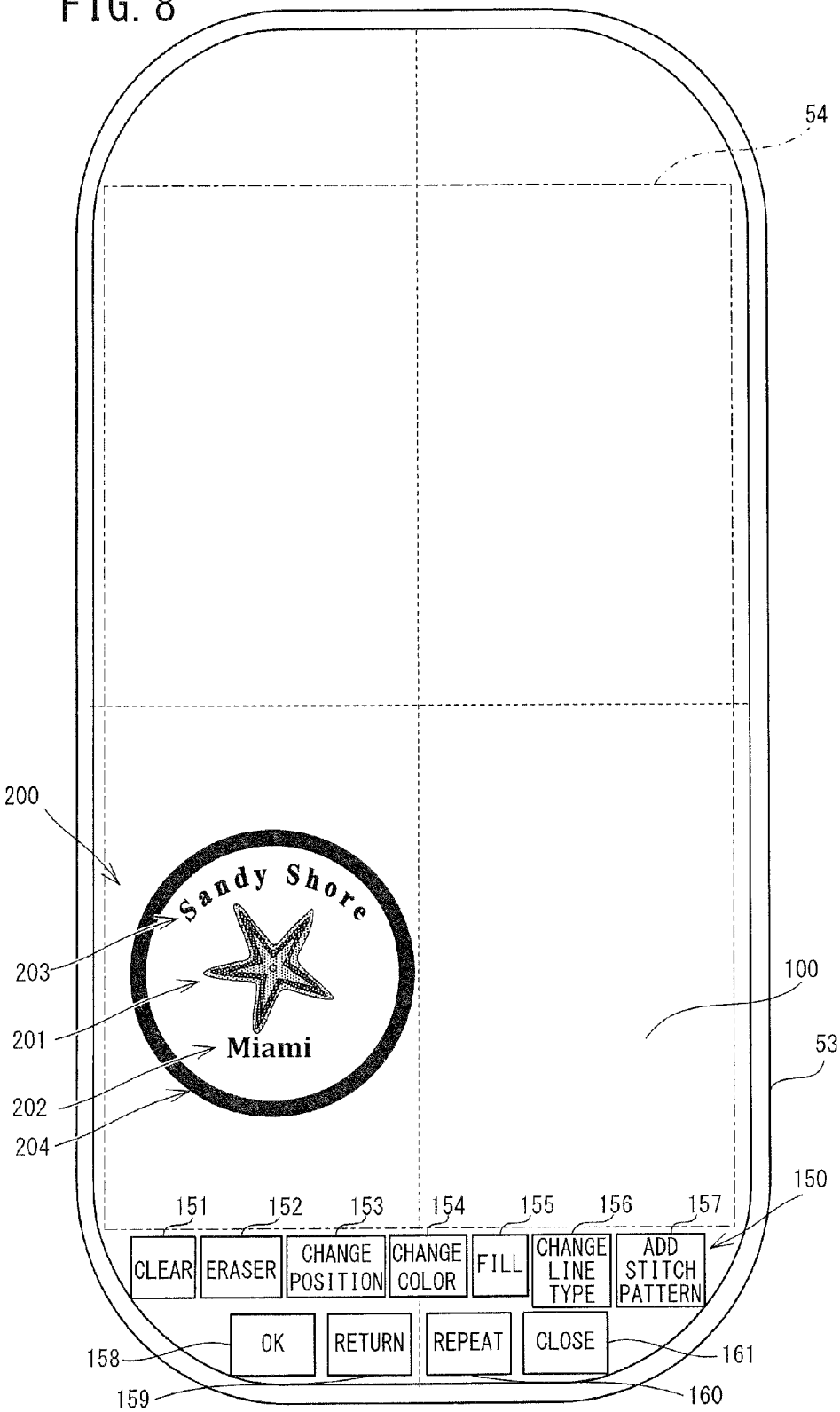
FIG. 8 is a plan view of an embroidery frame.

A method for specifying a position on the sewing workpiece 100 that the user has designated with the ultrasonic pen 91 will be explained with reference to FIGS. 1 and 7. The user may designate a position on the sewing workpiece 100 by pressing the pen tip 911 of the ultrasonic pen 91 against the sewing workpiece 100. Hereinafter, the position on the sewing workpiece 100 against which the pen tip 911 of the ultrasonic pen 91 has been pressed will be called the designated position. In the present embodiment, in a state in which the embroidery frame 53 that holds the sewing workpiece 100 has been mounted in the embroidery device 2, the designated position is located within the embroidery frame 53 and within the projection range Q of the projector 40. As will be described below, the sewing machine 1 specifies the designated position by specifying the position of the transmission source of the ultrasonic waves. Therefore, strictly speaking, the position that is specified as the designated position is not the position on the sewing workpiece 100 against which the pen tip 911 is pressed, but is the position of the ultrasonic transmitter 915 that is provided in the ultrasonic pen 91. However, the pen tip 911 and the ultrasonic transmitter 915 are located extremely close to one another. Therefore, the position of the ultrasonic transmitter 915 can be regarded as the position on the sewing workpiece 100 against which the pen tip 911 is pressed, that is, as the designated position. Hereinafter, the left-right direction, the front-rear direction, and the up-down direction in the sewing machine 1 are respectively defined as the X direction, the Y direction, and the Z direction. The left-right direction and the up-down direction in FIG. 8 are respectively equivalent to the X direction and the Y direction. The direction from the front side of the page to the rear side of the page is equivalent to the Z direction.

The sewing machine 1 may specify the designated position in the form of the three-dimensional coordinate information of the world coordinate system (an X coordinate, a Y coordinate, and a Z coordinate). In the present embodiment, the origin point (0, 0, 0) of the coordinate system is the center point of a needle hole 32. The needle hole 32 is a hole that is formed in the needle plate 34 (refer to FIG. 1) in a position that is directly beneath the needle bar 29. The sewing needle (not shown in the drawings) that is mounted on the needle bar 29 may pass through the needle hole 32 in the up-down direction during the sewing. The plane on which the Z coordinate is zero is equivalent to the top face of the needle plate 34. Coordinates B that indicate the position of the microphone 944 of the receiver 94 are defined as (Xb, Yb, Zb). Coordinates C that indicate the position of the microphone 944 of the receiver 95 are defined as (Xc, Yc, Zc). The coordinates B (Xb, Yb, Zb) and the coordinates C (Xc, Yc, Zc) are stored in the ROM 62 in advance. The respective Z coordinates of the receivers 94, 95 indicate the heights of the microphones 944 of the receivers 94, 95 in relation to the top face of the needle plate 34. Coordinates E that indicate the designated position are defined as (Xe, Ye, Ze). Hereinafter, the coordinates E are referred to as the designated coordinates E. The distance between the designated coordinates E and the coordinates B is referred to as the distance EB. The distance between the designated coordinates E and the coordinates C is referred to as the distance EC.

Based on the Pythagorean theorem, the distances EB, EC can be represented by the coordinates B, C, E. The relationship among the distance EB, the coordinates B, and the coordinates E is represented by Equation (1) below. In the same manner, the relationship among the distance EC, the coordinates C, and the coordinates E is represented by Equation (2) below.

$$(Xb-Xe)^2+(Yb-Ye)^2+(Zb-Ze)^2=(EB)^2 \quad (1)$$

$$(Xc-Xe)^2+(Yc-Ye)^2+(Zc-Ze)^2=(EC)^2 \quad (2)$$

Note that Equation (1) is identical to an equation for a spherical surface that has a radius of the distance EB, that has the center point that is defined by the coordinates B, and that intersects the coordinates E. In the same manner, Equation (2) is identical to an equation for a spherical surface that has a radius of the distance EC, that has the center point that is defined by the coordinates C, and that intersects the coordinates E.

The velocity at which the ultrasonic waves travel is the velocity of sound V. The times that are required for the ultrasonic waves, which are transmitted from the ultrasound pen 91 that designates the coordinates E, to be detected by the receivers 94 and 95 are respectively defined as a transmission time Tb and a transmission time Tc. In this case, the distances EB and EC can respectively be represented by Equations (3) and (4) below.

$$EB=V\times Tb \tag{3}$$

$$EC=V\times Tc \tag{4}$$

Substituting Equations (3) and (4) into Equations (1) and (2) yields Equations (5) and (6) below.

$$(Xb-Xe)^2+(Yb-Ye)^2+(Zb-Ze)^2=(V\times Tb)^2 \tag{5}$$

$$(Xc-Xe)^2+(Yc-Ye)^2+(Zc-Ze)^2=(V\times Tc)^2 \tag{6}$$

In Equations (5) and (6), the coordinates B (Xb, Yb, Zb), the coordinates C (Xc, Yc, Zc) and the velocity of sound V are known values, which are stored in the ROM 62. The time when the ultrasonic waves are transmitted from the ultrasound transmitter 915 of the ultrasonic pen 91 is defined as the transmission time T1. The times when the ultrasonic waves are detected by the receivers 94 and 95 are defined as the detection time T2*b* and the detection time T2*c*, respectively. In this case, the transmission times Tb and Tc can be identified by calculating the difference between the transmission time T1 and the detection time T2*b* and the difference between the transmission time T1 and the detection time T2*c*, respectively. In the present embodiment, the feed dog 35 does not move the work cloth 100 in the Z axis direction (the up-down direction of the sewing machine 1). Therefore, as long as the thickness of the work cloth 100 is within a range where the thickness can be ignored, the Z coordinate of the position of the top face of the work cloth 100 may be defined as zero. Accordingly, the CPU 61 can calculate the coordinates E (Xe, Ye, Ze) (Ze=0) based on the simultaneous Equations (5) and (6) and on the directionalities of the receivers 94 and 95.

An overview of the main processing that is performed in the sewing machine 1 in a first embodiment will be explained with reference to FIG. 8. The sewing machine 1 in the present embodiment is configured to set the edited stitch pattern and the sewing position of the edited stitch pattern, based on at least the plurality of designated positions on the sewing workpiece 100 that the user has input using the ultrasonic pen 91, and also is configured to create stitch pattern data for the edited stitch pattern. The stitch pattern data are data for forming the stitches that represent the edited stitch pattern, in the sewing position of the edited stitch pattern. In the main processing in the present embodiment, the projector 40 projects a menu image 150 into an area toward the front of the sewing machine 1 that is inside the embroidery frame 53, but is outside a sewing area 54. The sewing area 54 is an area inside the embroidery frame 53 in which stitches can be formed by the sewing machine 1. In other words, stitches are not formed in the area in which the menu image 150 is projected. Therefore, because the edited stitch pattern is located within the sewing area 54, the menu image 150 that is projected onto the sewing workpiece 100 basically does not interfere with the designating process of the shape of the edited stitch pattern and the sewing position of the edited stitch pattern. The menu image 150 may include eleven icons 151 to 161, for example. By using the ultrasonic pen 91 to select from among the icons 151 to 161 that are included in the menu image 150, the user can input various types of commands for setting the edited stitch pattern.

The icon 151 is to be selected in a case where the whole of the edited stitch pattern will be deleted. The icon 152 is to be selected in a case where a designated part of the edited stitch pattern will be deleted. The icon 153 is to be selected in a case where the position will be changed for a designated part of the edited stitch pattern. The icon 154 is to be selected in a case where the color will be changed for the stitches that represent a designated line within the edited stitch pattern. The icon 155 is to be selected in a case where fill stitches to be formed in a closed region that has been designated within the edited stitch pattern. The closed region is a region that is enclosed by one or more lines. The icon 156 is to be selected in a case where a line type will be changed for a designated line within the edited stitch pattern. In the present embodiment, the line type indicates the thickness of the line. The thickness of the line corresponds to the thickness of the stitches that form the line. In other words, in a case where the line type is changed, the type of the stitches that form the line is changed. The icon 157 is to be selected in a case where a stitch pattern that is stored in a storage device that is electrically connected to the sewing machine 1 will be added to the edited stitch pattern. The stitch pattern that is stored in the storage device may be one of a utility stitch pattern, a text character stitch pattern, an ornamental border stitch pattern, and a character stitch pattern, for example. The icon 158 is to be selected in a case where editing of the edited stitch pattern is finished and the stitch pattern data for the edited stitch pattern will be created. The icon 159 is to be selected in a case where the last operation will be canceled. The icon 160 is to be selected in a case where the last operation will be repeated. The icon 161 is to be selected in a case where the main processing will be terminated.

In the present embodiment, the edited stitch pattern is a stitch pattern in which a point, a line, a closed region, and a selected stitch pattern are combined as desired. As the point, a shape (for example, a circle) and a position where the point is to be formed may be specified based on a single designated position, for example. The line is at least one of a straight line and a curved line, and as the line. A shape and a position where the line is to be formed may be specified based on a plurality of designated positions that are output sequentially, for example. The closed region may be specified based on a single designated position, for example. In the present embodiment, fill stitches can be formed in the closed region that the user has designated. The selected stitch pattern includes one or more stitch patterns that have been selected from among a plurality of stitch patterns that are stored in a storage device that is electrically connected to the sewing machine 1. The size and the sewing position of the selected stitch pattern may be specified based on one or more designated positions. The storage device that is electrically connected to the sewing machine 1 may be, for example, one of the ROM 62, the RAM 63, and the flash ROM 64 of the sewing machine 1, and the storage device may also be an external storage device such as a memory card or the like.

For example, the user can cause the sewing machine 1 to create the stitch pattern data for an edited stitch pattern 200 by designating a position on the sewing workpiece 100 that is held by the embroidery frame 53 by using the ultrasonic pen 91. As shown in FIG. 8, the edited stitch pattern 200 includes a starfish stitch pattern 201, alphabetic character stitch patterns 202 and 203, and a circular ornamental border stitch pattern 204. In the main processing, which will be described later, the sewing machine 1 is able to specify the shape of the stitch pattern 201 based on a series of designated positions, for example, and able to set, based on edit processing that utilizes the menu image 150, line types, colors, fills, and the like in figures that are included in the stitch pattern 201. The sewing machine 1 can read the stitch patterns 202 to 204 from the flash ROM 64, based on the coordinates of the designated positions, and in accordance with the coordinates of the designated positions, can arrange the patterns 202 to 204 in the positions where they will be formed on the sewing workpiece 100 respectively.

In the present embodiment, the stitch pattern data for the edited stitch pattern include the coordinate data in the embroidery coordinate system and thread color data. The coordinate data represent the positions of the needle drop points on the sewing workpiece 100 that is held in the embroidery frame 53. The coordinate data are amended as necessary in a case where the sewing position of the edited stitch pattern in relation to the sewing workpiece 100 has been changed. In the present embodiment, the embroidery coordinate system and the world coordinate system are correlated with one another in advance. Therefore, the sewing machine 1 is able to amend the coordinate data that are expressed in the embroidery coordinate system, based on the coordinates in the world coordinate system that represent the shape of the edited stitch pattern and the sewing position of the edited stitch pattern. The thread color data are data that represent the colors of the threads that will form the stitches. The thread color data are set in accordance with the colors of the points, the lines, the closed regions, and the selected stitch patterns that are included in the edited stitch pattern.

Figure 9:
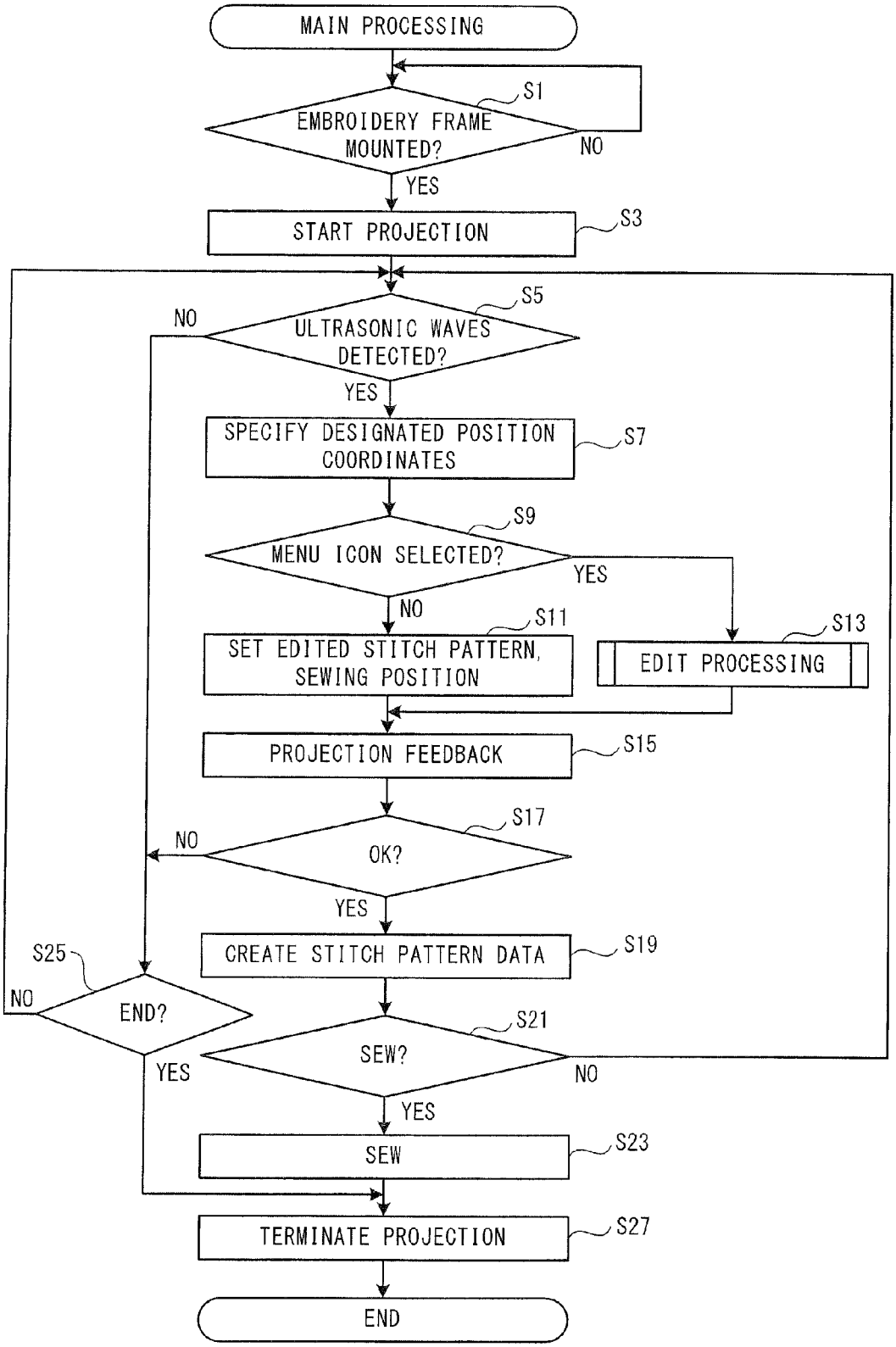
FIG. 9 is a flowchart of main processing.

The main processing in FIG. 9 will be explained with reference to FIGS. 8 to 12. The main processing in FIG. 9 is performed in a case where, for example, the user inputs a start command through the panel operation. The main processing is started in a state (a positioned state) in which the sewing workpiece 100 has been positioned in relation to the needle bar 29 by the mounting of the embroidery frame 53 that holds the sewing workpiece 100 on the embroidery device 2. The main processing is started in the positioned state in order to ensure that in the main processing, the sewing position of the edited stitch pattern, which is set based on the detection of the ultrasonic waves, will be congruent with the position where the sewing machine 1 will form the stitches that represent the edited stitch pattern. The program that implements the main processing in FIG. 9 is stored in the ROM 62 in FIG. 6 and is executed by the CPU 61. Data that are acquired and computed in the course of the main processing are stored in the RAM 63 as necessary. As a specific example, a case will be explained in which the stitch pattern data for the edited stitch pattern 200 in FIG. 8 are created, and the stitches that represent the edited stitch pattern 200 are formed based on the created stitch pattern data.

As shown in FIG. 9, in the main processing, based on an output signal from the detection portion 27 (refer to FIG. 6), the CPU 61 determines whether or not the embroidery frame 53 has been mounted on the embroidery device 2 (Step S1). In a case where the embroidery frame 53 has not been mounted on the embroidery device 2 (NO at Step S1), the CPU 61 waits until the embroidery frame 53 is mounted on the embroidery device 2. In a case where the embroidery frame 53 has been mounted on the embroidery device 2 (YES at Step S1), the CPU 61 operates the drive circuit 78 and the light source 46 and starts the projecting of the projection image by the projector 40 (Step S3). At Step S3, the CPU 61 specifies the type of the embroidery frame 53 that is mounted on the embroidery device 2, based on the output signal from the detection portion 27. The CPU 61 specifies the current position of the embroidery frame 53. The CPU 61 causes an initial projection image to be projected in accordance with the type of the embroidery frame 53, the sewing area table that is stored in the flash ROM 64, and the current position of the embroidery frame 53. The initial projection image may include the menu image 150, for example. These processing make it possible for the CPU 61 to project the menu image 150 into an area that is inside the embroidery frame 53, but is outside the sewing area 54, as shown in FIG. 8, even in a case where the type of the embroidery frame 53 has changed or the current position of the embroidery frame 53 has changed.

Next, the CPU 61 determines whether or not the receivers 94 and 95 have detected the ultrasonic waves (Step S5). When the pen tip 911 is pressed against the sewing workpiece 100, the signal output circuit 914 (refer to FIG. 6) outputs an electrical signal through the cable 912. At the same time, the ultrasonic transmitter 915 (refer to FIG. 6) transmits the ultrasonic waves. The CPU 61 specifies, as a transmission time T1, the time when it detects the electrical signal that has been output from the signal output circuit 914. The CPU 61 specifies, as detection times T2*b* and T2*c*, the respective times when it recognizes that the receivers 94 and 95 have detected the ultrasonic waves. In a case where any one of the transmission time T1 and the detection times T2*b* and T2*c* has not been specified, the CPU 61 determines that the detection of the ultrasonic waves has not been completed (NO at Step S5). In that case, if a command to terminate the main processing has not been input (NO at Step S25), the CPU 61 returns the processing to Step S5. The command to terminate the main processing may be input by one of a panel operation and the selecting of the icon 161 by the ultrasonic pen 91.

In a case where the CPU 61 has specified all of the transmission time T1 and the detection times T2*b* and T2*c*, the CPU 61 determines that the ultrasonic waves have been detected (YES at Step S5). Based on the transmission time T1 and the detection times T2*b* and T2*c* that were specified at Step S5, as well as on the simultaneous equations that were described earlier and on the directionalities of the receivers 94 and 95, the CPU 61 specifies the coordinates of the designated position in the world coordinate system (Step S7). Based on the coordinates of the designated position that were specified at Step S7, the CPU 61 determines whether or not one of the menu icons has been selected (Step S9). In a case where the coordinates of the designated position that were specified at Step S7 lie within the projection range for the menu image 150, the CPU 61 determines that one of the menu icons has been selected (YES at Step S9) and performs the edit processing, which will be described later (Step S13). In a case where none of the menu icons has been selected (NO at Step S9), the CPU 61 sets the edited stitch pattern and the sewing position of the edited stitch pattern, based on the coordinates of the designated position that were specified at Step S7 (Step S11). In the specific example, the user draws a figure 210 while pressing the pen tip 911 of the ultrasonic pen 91 against the sewing workpiece 100, as shown in part A1 of FIG. 10. In this case, the ultrasonic pen 91 transmits the ultrasonic waves at specified intervals (for example, 20 milliseconds) for as long as the pen tip 911 is being pressed against the sewing workpiece 100. By repeatedly performing the processing at Steps S5 and S7, the CPU 61 successively specifies the world coordinates for a series of designated positions, the ultrasonic waves being transmitted at the specified intervals and the transmission time being different for each of the designated positions. The CPU 61 specifies an edited stitch pattern 230 by connecting the coordinates of the plurality of the specified designated positions successively using one of straight line and curved line. The sewing position of the edited stitch pattern 230 is expressed in the embroidery coordinate system and is set based on the coordinates of the plurality of specified designated positions in the world coordinate system and on the current position of the embroidery frame 53. In the specific example, the positions on the sewing workpiece 100 against which the user has pressed the pen tip 911 are collectively set as the sewing position of the edited stitch pattern 230.

Figure 10:
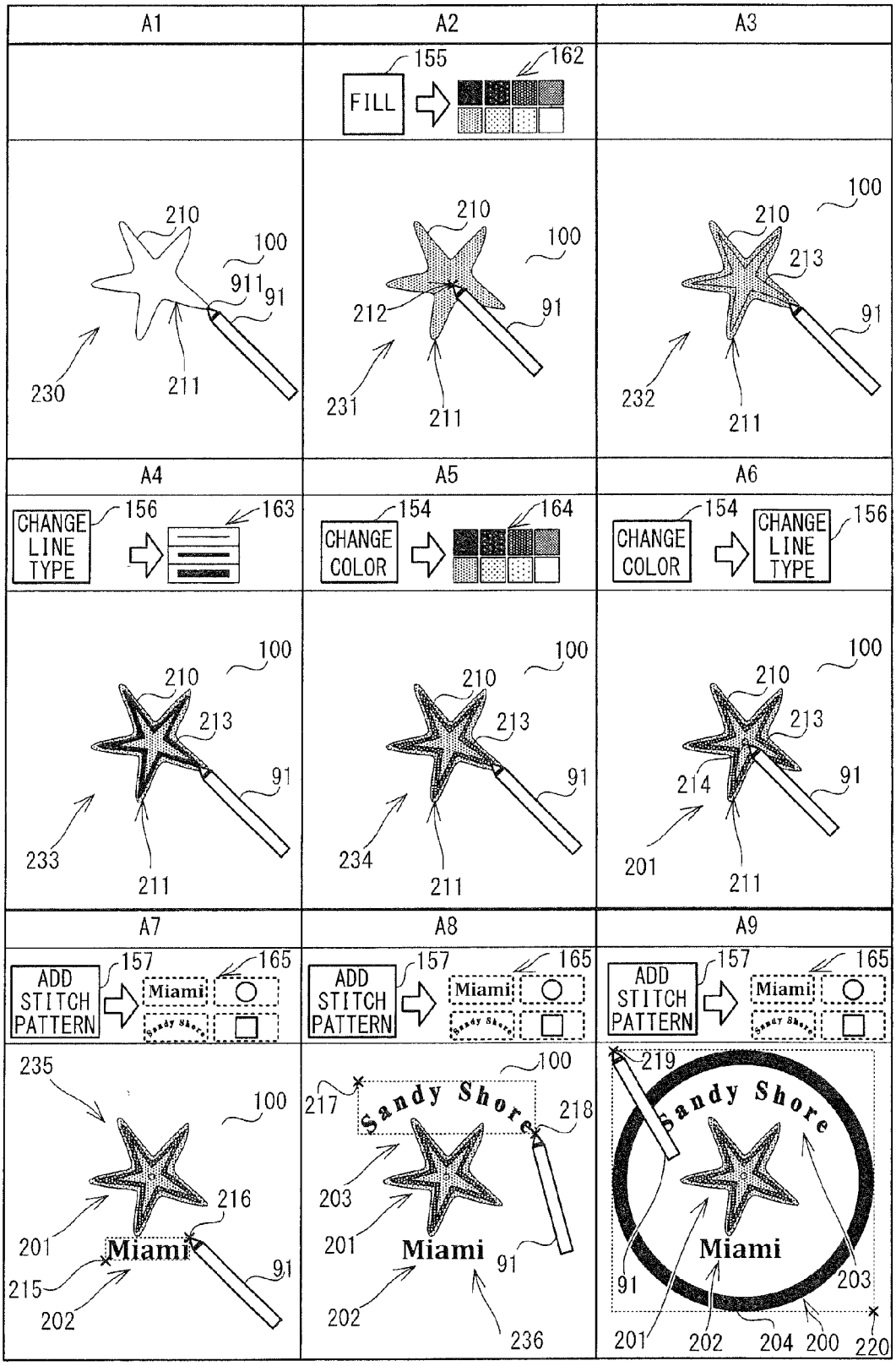
FIG. 10 is a state transition chart for explaining a process, in the main processing in FIG. 9, in which an edited stitch pattern and a position where the edited stitch pattern is to be formed are set based on designated positions, the chart segmenting the transition according to the edited stitch pattern and icons that are one of selected and projected.

The CPU 61 performs processing that takes the results of the setting of the edited stitch pattern and the sewing position of the edited stitch pattern and incorporates them into the projection image (Step S15). Specifically, the CPU 61 creates image data for projecting an image that portrays the edited stitch pattern 230 in the sewing position of the edited stitch pattern. Based on the created image data, the CPU 61 operates the drive circuit 78 and the light source 46 to project the image that portrays the edited stitch pattern 230 in the sewing position of the edited stitch pattern on the sewing workpiece 100. The image data may be created by a known method. For example, the image data may be created by the method that is described in detail in Japanese Laid-Open Patent Publication No. 2011-194043, the relevant portions of which are herein incorporated by reference. In the specific example, the edited stitch pattern 230 that is shown in part A1 of FIG. 10 is projected in the sewing position of the edited stitch pattern 230 (Step S15). At Step S15 that follows Step S13, the edited stitch pattern that is the result of the edit processing at Step S13, which will be described later, is incorporated into the projection image. The CPU 61 determines whether or not OK has been input (Step S17). In a case where the editing of the edited stitch pattern has been finished, OK is input by one of selecting the icon 158 with the ultrasonic pen 91 and performing the panel operation. In a case where neither OK nor the command to terminate the main processing has been input (NO at Step S17; NO at Step S25), the CPU 61 returns the processing to Step S5.

At Step S9, in a case where one of the menu icons has been selected (YES at Step S9), the CPU 61 performs the edit processing (Step S13). In the edit processing, the processing that corresponds to the icon that has been selected using the ultrasonic pen 91 is performed. The edit processing will be explained with reference to FIGS. 11 and 12. In the edit processing that will hereinafter be explained, the processing that is performed varies according to the icon that the user has selected. The CPU 61 specifies the icon that the user has selected based on the coordinates of the designated position and on the position where the menu image 150 is projected. Therefore, in order to guide the user through the operating procedure for using the ultrasonic pen 91 to input the desired command, an explanation of the command that the user intends to input may be provided by audio, the projection image, and the like, although this will not be explained in detail in the description of the processing that follows.

Figure 11:
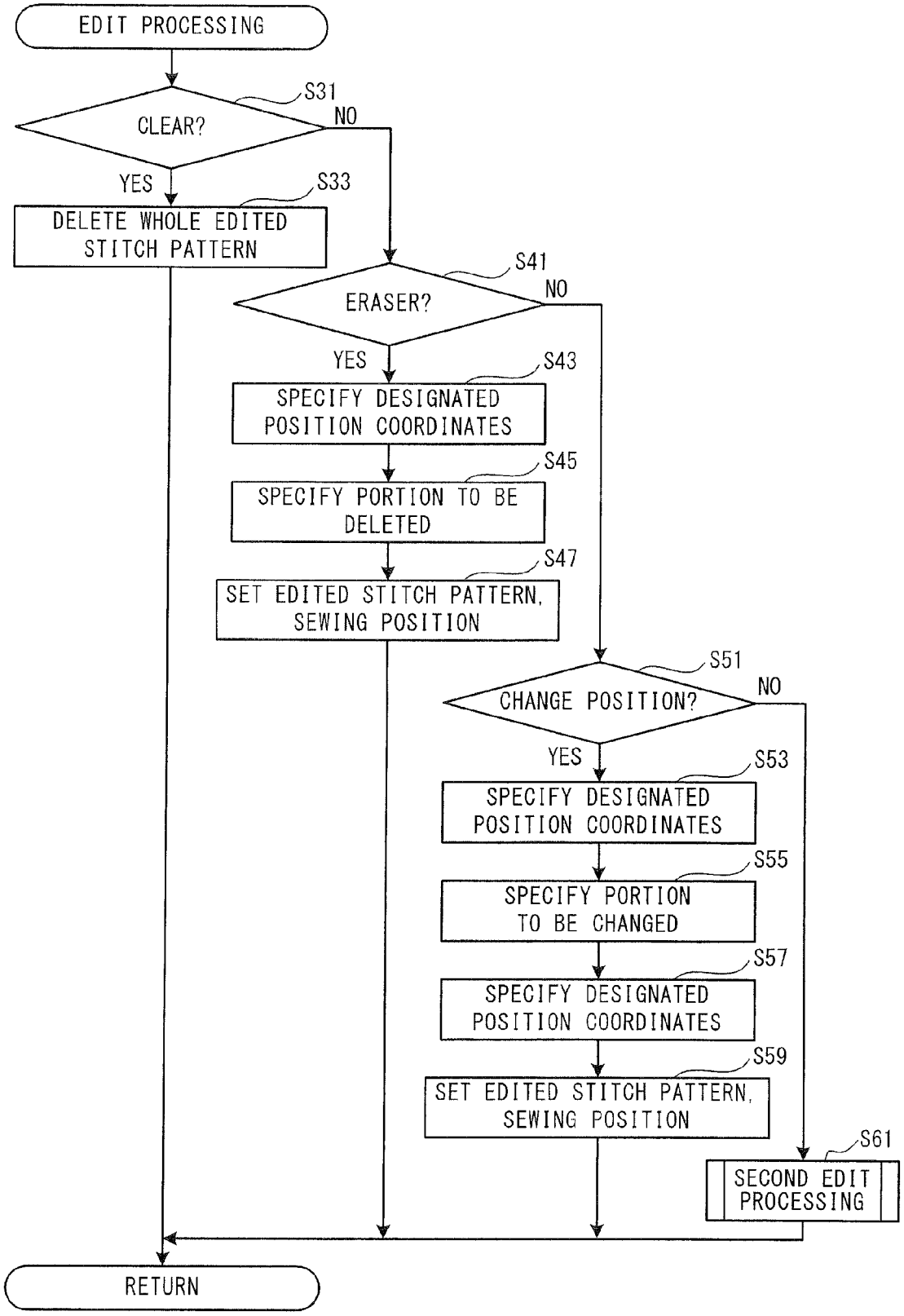
FIG. 11 is a flowchart of edit processing that is performed in the main processing in FIG. 9.

As shown in FIG. 11, the CPU 61, based on the coordinates of the designated position that were specified at Step S7 in FIG. 9, and on the position where the menu image 150 is projected, determines whether or not the icon 151 has been selected using the ultrasonic pen 91 (Step S31). In a case where the icon 151 has been selected (YES at Step S31), the CPU 61 deletes all of the edited stitch patterns that have been set prior to the performing of Step S33 (Step S33). In a case where the icon 152 has been selected (NO at Step S31; YES at Step S41), the CPU 61, by the same sort of processing as the processing at Steps S5 and S7 in FIG. 9, specifies the coordinates of one or more designated positions (Step S43), then specifies a portion to be deleted (Step S45). The method for specifying the portion to be deleted may be set in advance, and may also be set by the user. In a case where the portion to be deleted is the interior of a rectangular range that has been selected by the user, for example, the user may designate two diagonally opposite corners of the rectangle by using the ultrasonic pen 91. In that case, the CPU 61, by the same sort of processing as the processing at Steps S5 and S7 in FIG. 9, specifies the coordinates of the two designated positions (Step S43), then specifies, as the portion to be deleted, the interior of the rectangle having the two specified points as the diagonally opposite corners (Step S45).

In a case where the portion to be deleted is a line segment that the user has designated, for example, the user may designate the line segment within the edited stitch pattern that is projected onto the sewing workpiece 100 by using the ultrasonic pen 91 to designate one point on the line segment that is to be deleted. In that case, the CPU 61, by the same sort of processing as the processing at Steps S5 and S7 in FIG. 9, specifies the coordinates of the one designated position (Step S43), then specifies, as the portion to be deleted, the line segment that includes the specified point (Step S45). The CPU 61 sets, as the edited stitch pattern, the edited stitch pattern from which the portion that was specified by the processing at Step S45 has been deleted, and also sets the sewing position of the edited stitch pattern (Step S47).

In a case where the icon 153 has been selected (NO at Step S31; NO at Step S41; YES at Step S51), the CPU 61, by the same sort of processing as the processing at Steps S5 and S7 in FIG. 9, specifies the coordinates of one or more designated positions (Step S53), then specifies a portion to be changed (Step S55). The portion to be changed is a portion whose position to be formed will be changed and the method for specifying the portion to be changed may be set in advance, and may also be set by the user. For example, the portion to be changed may be specified by the same sort of method that is used at Step S45 to specify the portion to be deleted. The CPU 61 specifies the coordinates of the one or more designated positions (Step S57), then sets the post-change edited stitch pattern and the sewing position the edited stitch pattern, based on the specified coordinates (Step S59). The method for specifying the post-change position may be set in advance, and may also be set by the user. For example, as the post-change position, the user may designate a representative point in the portion to be changed. Any point that can indicate a position of the portion to be changed may be used as the representative point in the portion to be changed. The representative point may be a point that is set in advance, and it may be a point that the user has designated. For example, in a case where the designated portion to be changed is the interior of a rectangle having the two points that have been designated using the ultrasonic pen 91 as the endpoints of a diagonal (Steps S53, S55), the representative point in the portion to be changed may be the point that is input first, for example. In a case where the designated portion to be changed is a line segment that includes one point that has been designated using the ultrasonic pen 91 (Steps S53, S55), for example, the representative point in the portion to be changed may be the point that is used to designate the portion to be changed, for example. The post-change edited stitch pattern is a changed stitch pattern from the pre-change edited stitch pattern where the position of the portion to be changed has been changed.

In a case where an icon other than one of the icons 151 to 153 has been selected (NO at Step S31; NO at Step S41; NO at Step S51), second edit processing is performed (Step S61). The second edit processing will be explained with reference to FIG. 12. In the specific example, in a case where the user wants to form fill stitches in a closed region 211 that is bounded by the outline of the figure 210, the user presses the pen tip 911 of the ultrasonic pen 91 against the position of the icon 155. In that case, based on the coordinates of the designated position and on the position where the menu image 150 is projected, the CPU 61 determines that the icon 155 has been selected (NO at Step S71; YES at Step S91). The CPU 61 projects a palette 162, which is shown in part A2 of FIG. 10, close to the position where the icon 155 is being projected (Step S93). The palette 162 includes icons that display a plurality of colors. In the present embodiment, the color of the fill stitches to be formed in the closed region can be selected from among the plurality of colors that are included in the palette 162. The colors that are included in the palette 162 may be colors that are set in advance, and they may be colors that the user has registered in consideration of the colors that can be used and the like. The user presses the pen tip 911 of the ultrasonic pen 91 against the position of the icon for a desired color, among the icons for the plurality of colors that are included in the palette 162. The CPU 61 specifies the coordinates of the designated position in the same manner as in the processing at Steps S5 and S7 in FIG. 9 (Step S95). The CPU 61 specifies the selected icon based on the coordinates of the designated position and on the positions where the icons are projected. Based on the specified icon, the CPU 61 specifies the color of the fill stitches to be formed in the closed region (Step S97).

The user, while referring to the edited stitch pattern 230 that is projected onto the sewing workpiece 100, presses the pen tip 911 of the ultrasonic pen 91 against a point within the closed region 211 that is bounded by the outline of the figure 210. The point within the closed region 211 may be a point 212, for example. The CPU 61 specifies the coordinates of the designated position in the same manner as in the processing at Steps S5 and S7 in FIG. 9 (Step S99). Based on the coordinates of the specified designated position that were specified at Step S99, the CPU 61 specifies the closed region 211 that includes the designated position (Step S101). The CPU 61 specifies a correspondence relationship between the closed region 211 and the color of the fill stitches to be formed in the closed region 211, then stores the correspondence relationship in the RAM 63 (Step S103). In the processing described above, the fill stitches of the color that is specified at Step S97 are specified as the type of stitches to be formed in the closed region 211, based on the detection of the ultrasonic waves.

In the specific example, the user inputs a figure 213 in the same manner as the figure 210 is input, as shown in part A3 of FIG. 10. Based on the detection of the ultrasonic waves, the CPU 61 sets the shape of the figure 213 and the sewing position of the figure 213. In a case where the user wants to change the thickness of the stitches that form the outline of the figure 213 that is formed by the stitches, the user presses the pen tip 911 of the ultrasonic pen 91 against the position of the icon 156. In that case, based on the coordinates of the specified designated position and on the position where the menu image 150 is projected, the CPU 61 determines that the icon 156 has been selected (NO at Step S71; NO at Step S91; YES at Step S111). The CPU 61 projects a list 163, which is shown in part A4 of FIG. 10, close to the position where the icon 156 is being projected (Step S113). The list 163 contains icons of different line thicknesses. In the present embodiment, the thickness of the stitches that will form the outline can be selected from among the plurality of thicknesses that are included in the list 163 that is shown as an example in part A4 of FIG. 10. In the present embodiment, in the stitch type table that is stored in the flash ROM 64, the line types for the outline and the types of the stitches that can form the outline are associated with one another as will now be described. The narrowest line thickness corresponds to the thickness of the color of a straight line stitch. The line thicknesses other than the narrowest line thickness correspond to the stitch widths of the satin stitches, for example.

The user presses the pen tip 911 of the ultrasonic pen 91 against the position of the icon for a desired line type, among the plurality of icons that are included in the list 163. The CPU 61 specifies the coordinates of the designated position in the same manner as in the processing at Steps S5 and S7 in FIG. 9 (Step S115), then specifies the selected icon based on the specified coordinates and on the position where the list 163 is projected. The CPU 61 specifies the line type based on the selected icon (Step S117). The user presses the pen tip 911 of the ultrasonic pen 91 against a point on the outline of the figure 213 in an edited stitch pattern 232 that is projected on the sewing workpiece 100, the outline of the figure 213 being the object of the line type change. The CPU 61 specifies the coordinates of the designated position in the same manner as in the processing at Steps S5 and S7 in FIG. 9 (Step S119), then based on the coordinates of the specified designated position that were specified at Step S119, the CPU 61 specifies the outline of the figure 213 as the object of the line type change (Step S121). The CPU 61 specifies a correspondence relationship between the outline that was specified at Step S121 and the line type (the line thickness) that was specified at Step S117, then stores the correspondence relationship in the RAM 63 (Step S123). In the processing described above, satin stitches with the thickness that is specified at Step S117 are specified as the type of the stitches that will form the outline of the figure 213 that is the object of the change, based on the detection of the ultrasonic waves.

In the specific example, in a case where the user wants to change the color of the outline of the figure 213, the user presses the pen tip 911 of the ultrasonic pen 91 against the position of the icon 154. In that case, based on the coordinates of the specified designated position and on the position where the menu image 150 is projected, the CPU 61 determines that the icon 154 has been selected (YES at Step S71). The CPU 61 projects a palette 164, which is shown in part A5 of FIG. 10, close to the position where the icon 154 is being projected (Step S73). The palette 164 includes icons that display a plurality of colors. The palette 164 may be the same as the palette 162 that is projected at Step S93, and it may also be different from the palette 162. In the present embodiment, the color of the lines that are included in the edited stitch pattern can be selected from among the plurality of colors that are included in the palette 164. The user presses the pen tip 911 of the ultrasonic pen 91 against the position of the icon for a desired color, among the icons for the plurality of colors that are included in the palette 164. The CPU 61 specifies the coordinates of the designated position in the same manner as in the processing at Steps S5 and S7 in FIG. 9 (Step S75). The CPU 61 specifies the selected icon based on the coordinates of the designated position and on the position where the palette 164 is projected. Based on the specified icon, the CPU 61 specifies the color of the stitches that will form the lines (Step S77). The user presses the pen tip 911 of the ultrasonic pen 91 against a point on the outline of the figure 213, which is the object of the color change. The CPU 61 specifies the coordinates of the designated position in the same manner as in the processing at Steps S5 and S7 in FIG. 9 (Step S79). Based on the coordinates of the specified designated position that were specified at Step S79, the CPU 61 specifies the outline of the figure 213 as the line that is the object of the color change (Step S81). The CPU 61 sets an edited stitch pattern 234 and the sewing position of the edited stitch pattern 234, reflecting in the settings a correspondence relationship between the outline that was set at Step S81 and the color that was set at Step S77 (Step S83).

In the specific example, after inputting a figure 214, the user uses the ultrasonic pen 91 to input a command that causes the sewing machine 1 to implement the color change and the line type change that have been described above. Above operations complete the editing of the stitch pattern 201, as shown in part A6 of FIG. 10. In a case where the user wants to combine the stitch pattern 201 with the alphabetic character stitch patterns 202 and 203 that are stored in the flash ROM 64, the user presses the pen tip 911 of the ultrasonic pen 91 against the position of the icon 157. In that case, based on the coordinates of the specified designated position and on the position where the menu image 150 is projected, the CPU 61 determines that the icon 157 has been selected (NO at Step S71; NO at Step S91; NO at Step S111; YES at Step S131). The CPU 61 projects a stitch pattern list 165, which is shown in part A7 of FIG. 10, close to the position where the icon 157 is being projected (Step S133). The stitch pattern list 165 displays an image of the finished state of each of a plurality of stored stitch patterns. In the present embodiment, the stitch data for each of the plurality of stitch patterns are stored in the flash ROM 64. The number of the stitch patterns that are projected in the stitch pattern list 165, the layouts of the stitch patterns, and the types of the stitch patterns may be changed as desired. For example, the stitch patterns may be grouped into categories, and the stitch patterns may be projected by category in the stitch pattern list 165. The user presses the pen tip 911 of the ultrasonic pen 91 against the position of the icon that displays a desired stitch pattern, among the plurality of icons that are included in the stitch pattern list 165. The CPU 61 specifies the coordinates of the designated position in the same manner as in the processing at Steps S5 and S7 in FIG. 9 (Step S135). The CPU 61 specifies the selected stitch pattern, which is the stitch pattern that has been selected, based on the coordinates of the specified designated position that were specified at Step S135 and on the position where the stitch pattern list 165 is projected (Step S137). In the specific example, the stitch pattern 202 is specified as the selected stitch pattern. The user designates the positioning of the selected stitch pattern by using the ultrasonic pen 91. The method for positioning the selected stitch pattern may be set as desired. For example, the selected stitch pattern may be positioned by designating two diagonally opposite corners of the smallest rectangle within which the selected stitch pattern can be contained.

In the specific example, the user designates points 215 and 216 that are shown in part A7 of FIG. 10, for example. The CPU 61 specifies the coordinates of the two designated positions in the same manner as in the processing at Steps S5 and S7 in FIG. 9 (Step S139), then sets the sewing position of the stitch pattern 202 and the size of the stitch pattern 202, based on the coordinates of the specified designated position that were specified at Step S139 (Steps S141, S143). The sewing position of the stitch pattern 202 and the size of the stitch pattern 202 are set on the assumption that the two designated points 215 and 216 whose coordinates were specified at Step S139 are two diagonally opposite corners of the smallest rectangle within which the selected stitch pattern that is shown in part A7 of FIG. 10 can be contained. The CPU 61 sets an edited stitch pattern 235, which includes the stitch patterns 201 and 202, and the sewing position of the edited stitch pattern 235 (Step S145). The CPU 61 acquires the stitch data for the stitch pattern 202 from the flash ROM 64 as selected stitch data (Step S147). In the same manner, for the stitch pattern 203, points 217 and 218 are designated in that order, as shown in part A8 of FIG. 10 (Step S139), and the sewing position of the stitch pattern 203 (Step S141) and the size of the stitch pattern 203 (Step S143) are set. An edited stitch pattern 236, which includes the stitch patterns from 201 to 203, and the sewing position of the edited stitch pattern 236 are set (Step S145). For the stitch pattern 204, points 219 and 220 are designated in that order, as shown in part A9 of FIG. 10 (Step S139), and the sewing position of the stitch pattern 204 (Step S141) and the size of the stitch pattern 204 (Step S143) are set. The edited stitch pattern 200, which includes the stitch patterns from 201 to 204, and the sewing position of the edited stitch pattern 200 are set (Step S145). With these steps, the processing that edits the edited stitch pattern 200 is completed.

In a case where one of the icons 158 to 161 has been selected (NO at Step S71; NO at Step S91; NO at Step S111; NO at Step S131), as well as after one of Steps S83, S103, S123, and S147 in FIG. 12 has been performed, the CPU 61 returns the processing to the edit processing in FIG. 11. After one of Steps S33, S47, S59, and S61 in FIG. 11 has been performed, the CPU 61 returns the processing to the main processing in FIG. 9. At Step S15 that follows Step S13, the projection image that is projected incorporates the changes that were made in the edit processing at Step S13. In a case where Step S13 is performed after the processing at Step S33 in FIG. 11, the projection image that is projected is one in which all of the edited stitch patterns have been deleted. In a case where Step S13 is performed after the processing at Step S47, the projection image that is projected is one in which the edited stitch pattern that was set at Step S47 is projected in the sewing position. In a case where Step S13 is performed after the processing at Step S59, the projection image that is projected is one in which the edited stitch pattern that was set at Step S59 is projected in the sewing position. In a case where Step S13 is performed after the processing at Step S83 in FIG. 12, the projection image that is projected is one in which the color of the portion to be changed that was specified at Step S81 has been changed. For example, the projection image is switched from an image that displays an edited stitch pattern 233 that is shown in part A4 of FIG. 10 to an image that displays the edited stitch pattern 234 that is shown in part A5.

At Step S13 that follows the processing at Step S103, the projection image that is projected is one in which the closed region that was specified at Step S101 is filled in with the color that was specified at Step S97. For example, the projection image is switched from an image that displays the edited stitch pattern 230 that is shown in part A1 of FIG. 10 to an image that displays an edited stitch pattern 231 that is shown in part A2. At Step S13 that follows the processing at Step S123, the projection image that is projected is one in which the line type of the portion to be changed that was specified at Step S121 has been changed to the line type that was specified at Step S117. For example, the projection image is switched from an image that displays the edited stitch pattern 232 that is shown in part A3 of FIG. 10 to an image that displays the edited stitch pattern 233 that is shown in part A4. At Step S13 that follows the processing at Step S147, the projection image that is projected is one in which the selected stitch pattern that was specified at Step S137 is positioned at the position that was specified at Step S141 and at the size that was specified at Step S143, and in which the edited stitch pattern that was specified at Step S145 is projected at the sewing position. For example, an image that displays the edited stitch pattern 235 in part A7, an image that displays the edited stitch pattern 236 in part A8, and an image that displays the edited stitch pattern 200 in part A9 are displayed in succession.

In the specific example, in a state in which the edited stitch pattern 200 and the sewing position of the edited stitch pattern 200 have been set, and the edited stitch pattern 200 is projected on the sewing workpiece 100 at the sewing position, as shown in part A9 of FIG. 10, OK is selected (YES at Step S17). In that case, the CPU 61 creates the stitch pattern data based on at least the edited stitch pattern 200 and the position that has been set as the sewing position of the edited stitch pattern 200 (Step S19). Data that represent the stitches in each of the stitch patterns from 201 to 204 that are included in the edited stitch pattern 200 will be called partial stitch pattern data. The partial stitch pattern data for the stitch pattern 201, for example, are created as will now be described. Data for forming the fill stitches in the closed region 211 are created based on the coordinates that reperesnt the figure 210 in the embroidery coordinate system and on the correspondence relationship that was stored in the RAM 63 at Step S103 in FIG. 12. The thread density for the fill stitches may be set in advance and may also be designated by the user. In a case where the outline of the closed region 211 is delineated by the stitches, the CPU 61 may create data for forming the outline in straight line stitches or satin stitches. Data for using the satin stitches with the thickness that was specified at Step S117 to represent the outline of figure 213 are created based on the coordinates that represent the figure 213 in the embroidery coordinate system, on the correspondence relationship that was stored in the RAM 63 at Step S123 in FIG. 12, and on the stitch type table that is stored in the flash ROM 64. Data are created for using straight line stitches to represent the outline of figure 214. The feed pitch for the straight line stitches may be set in advance and may also be designated by the user.

The partial stitch pattern data for the stitch pattern 202 are created based on the selected stitch data of the stitch pattern 202, the sewing position of the stitch pattern 202 and the size of the stitch pattern 202. The selected stitch data of the stitch pattern 202 are acquired at Step S147 in FIG. 12. The sewing position of the stitch pattern 202 is set at Step S141 and is represented by the coordinates in the embroidery coordinate system. The size of the stitch pattern 202 is set at Step S143. The partial stitch pattern data for the stitch patterns 203 and 204 are created in the same manner as are the partial stitch pattern data for the stitch pattern 202. Next, the CPU 61 creates the stitch pattern data based on the partial stitch pattern data. The CPU 61 creates the stitch pattern data by determining the order in which the stitch patterns from 201 to 204 will be formed so as to make the number of times of thread replacements as few as possible. It is also acceptable, in consideration of the number of times of thread replacements, for the sewing machine 1 to sew the stitch pattern 204 midway through the sewing of the stitch pattern 201, for example.

The CPU 61 determines whether or not a command to start sewing has been input (Step S21). The command to start sewing is input by one of performing the panel operation and depressing one of the operation switches 21. In a case where the command to start sewing has not been input (NO at Step S21) for a specified length of time (for example, ten minutes), the processing returns to Step S5. In a case where the command to start sewing has been input (YES at Step S21), the sewing machine 1 forms the stitches that represent the edited stitch pattern 200 by controlling the drive circuits 71, 74, and 75 based on the stitch pattern data that were created at Step S19 (Step S23). In the processing at Step S23, the stitches that represent the edited stitch pattern 200 are formed in the sewing position of the edited stitch pattern 200 on the sewing workpiece 100, as shown in FIG. 8, for example. The CPU 61 terminates the projecting by the projector 40 (Step S27), then terminates the main processing.

The sewing machine 1 sets the edited stitch pattern and the sewing position of the edited stitch patterns, based on at least a plurality of designated positions that are specified based on the detection of the ultrasonic waves. That is, the user is able to specify the edited stitch pattern and the sewing position of the edited stitch pattern by pressing the pen tip 911 of the ultrasonic pen 91 against the sewing workpiece 100 to generate the ultrasonic waves on the sewing workpiece 100. In the sewing machine 1, it is not necessary to perform processing that designates the sewing position of the edited stitch pattern separately from the operations by which the user edits the stitch patterns, as is done in the known sewing machine. Therefore, the sewing machine 1 is able to form the edited stitch patterns in the desired positions easily. The user needs only to use the ultrasonic pen 91 to designate the positions on the sewing workpiece 100 where the stitches that represent the edited stitch patterns will actually be formed, so the finished state of the stitches is easier to visualize than in a case where the edited stitch patterns are designated using the touch panel 26, for example.

The edited stitch pattern 200 that has been edited using the ultrasonic pen 91 is projected by the projector 40 in the sewing position of the edited stitch pattern 200 on the sewing workpiece 100. Therefore, based on the projected image, the user is able to check both whether or not the edited stitch pattern 200 has been edited as desired and whether or not the edited stitch pattern 200 has been positioned at the desired position. While checking the projected image, the user can use the ultrasonic pen 91 to input a command and can cause the sewing machine 1 to perform the sewing of the edited stitch pattern 200. The sewing machine 1 includes the embroidery device 2. Therefore, the edited stitch patterns can be sewn using the embroidery device 2, which allows for a higher degree of freedom in the editing of the edited stitch patterns than can be done for a utility stitch pattern that can be formed using the feed dog 35.

Figure 12:
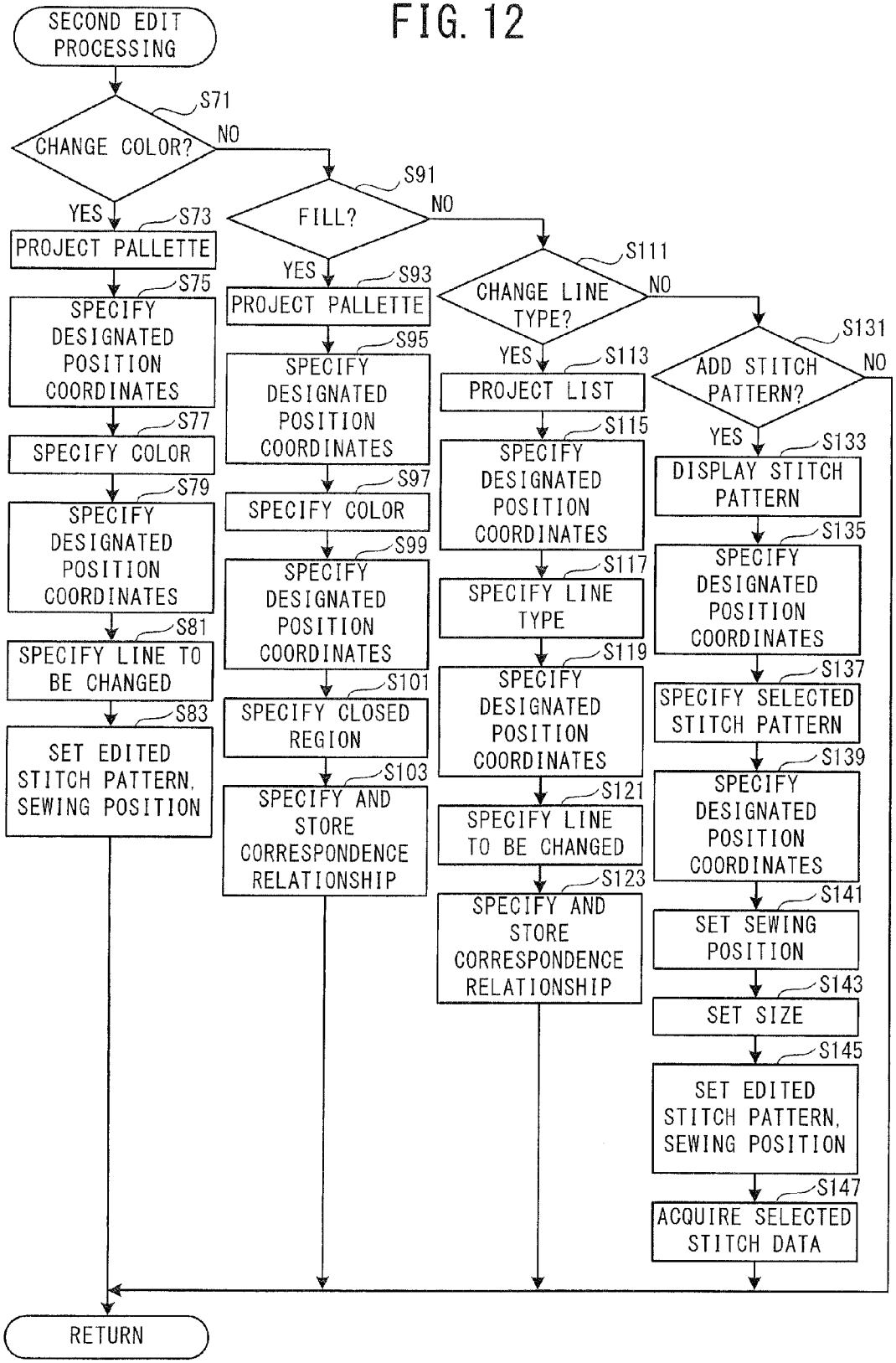
FIG. 12 is a flowchart of second edit processing that is performed in the edit processing in FIG. 11.

By performing the processing from Step S91 to Step S103 in FIG. 12, the sewing machine 1 can specify, for one or more closed regions that are included in the edited stitch pattern, the type of the stitches to be formed in the one or more closed regions, doing so in response to the user's commands. When designating the type of the stitches to be formed in the one or more closed regions, the user, while referring to the projected image and using the ultrasonic pen 91, needs only to designate the position that will be used in the processing that specifies the closed region. Therefore, the sewing machine 1 is able to make the editing of the edited stitch pattern more convenient for the user than in a case where the type of the stitches to be formed in the closed region cannot be designated. By performing the processing from Step S111 to Step S123, the sewing machine 1 can specify, for one or more lines that are included in the edited stitch pattern, the type of the stitches that represent the one or more lines, doing so in response to the user's commands. When designating the type of the stitches that represent the one or more lines, the user, while referring to the projected image and using the ultrasonic pen 91, needs only to designate the line for which the stitch type will be changed and what the stitch type will be after the change. Therefore, the sewing machine 1 is able to make the editing of the edited stitch pattern more convenient for the user than in a case where the type of the stitches that represents the line that is included in the edited stitch pattern cannot be designated. By performing the processing from Step S31 to Step S59, the sewing machine 1 can amend at least one of the edited stitch pattern and the sewing position of the edited stitch pattern, based on the detection of the ultrasonic waves.

By the simple operation of generating the ultrasonic waves on the sewing workpiece 100, the user is able to output to the sewing machine 1 one of a command to amend and a command to delete at least one portion of the edited stitch pattern. The sewing machine 1 is able to make the editing of the edited stitch pattern more convenient for the user than in a case where the at least one portion of the edited stitch pattern cannot be amended or deleted. When the user has used the ultrasonic pen 91 to input one of the command to amend and the command to delete the at least one portion of the edited stitch pattern, the resulting change is reflected immediately in the projection image. That makes it possible for the user to confirm, based on the projection image, whether or not the at least one portion of the edited stitch pattern has been amended or deleted as intended. By performing the processing from Step S131 to Step S147, the sewing machine 1 can set the edited stitch pattern by utilizing a selected stitch pattern that is stored in a storage device that is electrically connected to the sewing machine 1. By the simple operation of generating the ultrasonic waves on the sewing workpiece 100, the user is able to output to the sewing machine 1 a command to use the selected stitch pattern for setting the edited stitch pattern and the sewing position of the edited stitch pattern. For example, the desired edited stitch pattern can be formed by using a stitch pattern with a complex shape that would be difficult for the user to designate using the ultrasonic pen 91. The sewing machine 1 is thus able to make the editing of the edited stitch pattern more convenient for the user.

The sewing machine according to the present disclosure is not limited to the embodiments described above, and various types of modifications may be made insofar as they are within the scope of the present disclosure. For example, the modifications (A) to (F) described below may be made as desired.

(A) The configuration of the sewing machine 1 may be modified as desired. The sewing machine may also be another type of sewing machine, such as an industrial sewing machine, a multi-needle sewing machine, or the like, for example. In a case where the sewing machine is a multi-needle sewing machine, the colors that are included in the palettes that are projected at Steps S73 and S93 may be the colors of the threads that are supplied to the sewing needles that are mounted on the needle bars, for example. The sewing machine may also be a sewing machine that is not provided with an embroidery device. The sewing machine may also be a sewing machine in which an embroidery device is an integral part of the sewing machine. The sewing workpiece may be anything in which a stitch can be formed. The sewing machine may also include a device (a detection device) that detects a designated position that may be any position on the sewing workpiece, and the sewing machine and the detection device may also be separate units.

Figure 13:
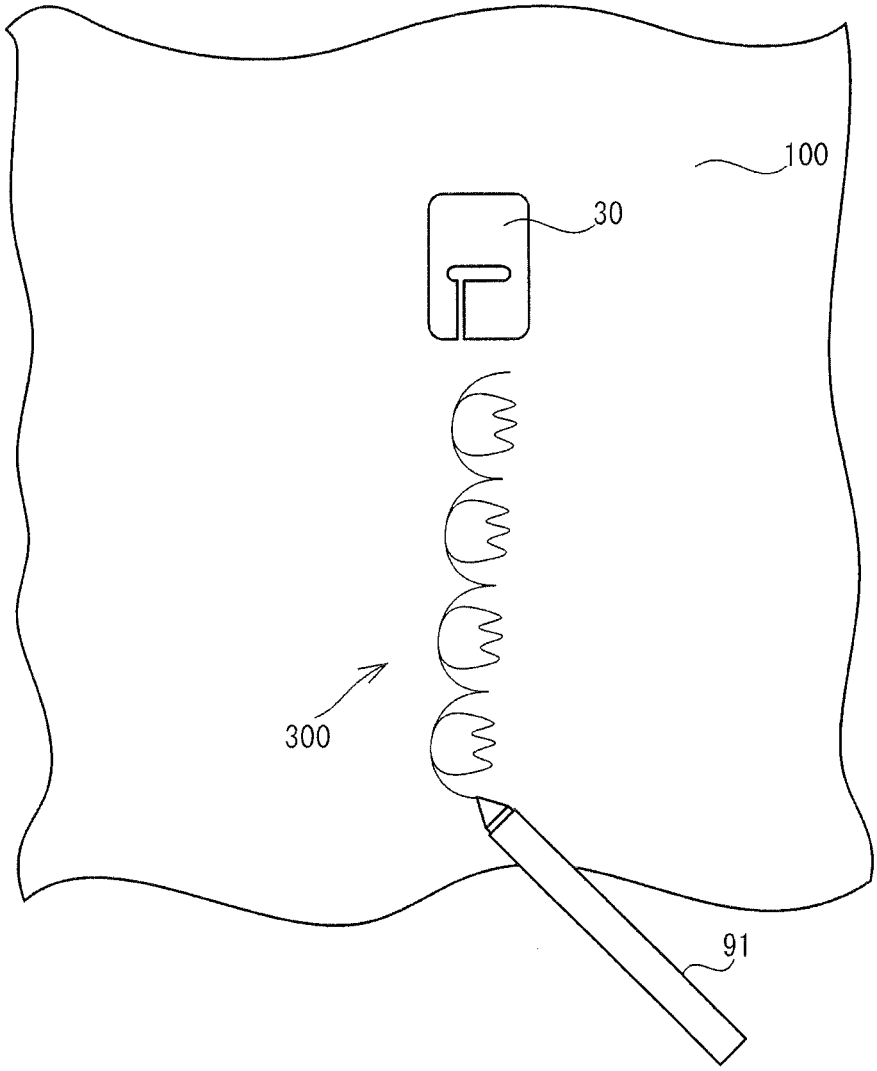
FIG. 13 is an explanatory figure of a case in which a utility stitch pattern is edited by using the ultrasonic pen on a sewing workpiece that has been placed on a bed and pressed by a presser foot.

The sewing workpiece may also be fed in the front-rear direction and the left-right direction by the feed dog 35. In that case, it is acceptable for the sewing machine 1 not to include the embroidery device 2. A mechanism that uses the feed dog 35 to feed the sewing workpiece in the front-rear direction and the left-right direction may be, for example, the feed mechanism that is described in detail in Japanese Laid-Open Patent Publication No. 2008-272045, the relevant portions of which are herein incorporated by reference. The processing that is performed in a case where the feed dog 35 is used to feed the sewing workpiece in the front-rear direction and the left-right direction may be as will hereinafter be described, for example. In the state (the positioned state) in which the sewing workpiece 100 is held by being pressed by the presser foot 30, and the sewing workpiece 100 has been positioned in relation to the needle bar 29, the user uses the ultrasonic pen 91 to indicate the shape of the edited stitch pattern. For example, with the sewing workpiece in the positioned state, the user may use the ultrasonic pen 91 to draw a stitch pattern 300 that is shown in FIG. 13. Based on the receiving of the ultrasonic waves, the CPU 61 of the sewing machine 1 specifies a plurality of designated positions, then specifies the shape of the stitch pattern 300 and the sewing position of the stitch pattern 300 based on the specified plurality of designated positions. The CPU 61 of the sewing machine 1 operates the projector 40 to project the stitch pattern 300 in the sewing position. The CPU 61 of the sewing machine 1 creates the stitch pattern data based on the shape of the stitch pattern 300 and on the sewing position of the stitch pattern 300. The coordinate data that are included in the stitch pattern data in this case prescribe an amount of movement of the feed dog 35. In this manner, the user is able to use the ultrasonic pen 91 to perform editing of a utility stitch pattern that is a stitch pattern that will be sewn as the feed dog 35 is used to feed the sewing workpiece, as well as to indicate the sewing position of the utility stitch pattern. Therefore, it is not necessary for the user to perform an operation that designates the sewing position of the edited stitch pattern separately from the operation by which the user edits the utility stitch pattern.

(B) A command that switches the editing function by the sewing machine 1 and a command that specifies an object of editing and the nature of the editing may also be input by a different method, such as the panel operation or the like, for example. In other words, some or all of the edit processing in FIG. 11 and the second edit processing in FIG. 12 may be performed based on commands that have been input by a different method, such as the panel operation or the like. The types and the number of the editing functions, as well as the method for editing the edited stitch pattern, may be added, omitted, and modified as desired. For example, known editing functions for figures, such as rotating, enlarging, and reducing the stitch pattern, moving fixed points, and the like, may also be used as editing functions. Each of the types of the stitches that represents the lines and the closed regions that are included in a stitch pattern may be made selectable by the user. It is also permissible that the type of the stitches are not selectable by the user. The types of the stitches that represent the lines and the closed regions that are included in a stitch pattern may be modified as desired. For example, a zigzag stitch may be defined as a stitch that can be formed as a stitch that represents a line.

(C) The structure of the stitch pattern data and the method for creating the stitch pattern data may be modified as desired. For example, in the case of an edited stitch pattern that will be sewn in one color, the thread color data may be omitted from the stitch pattern data. In a case where the sewing machine 1 creates the stitch pattern data for an edited stitch pattern that includes a selected stitch pattern, the partial stitch pattern data for the selected stitch pattern may be created in the same manner as for the stitch pattern that is edited like the stitch pattern 201 that was described earlier. The sewing machine 1 may also be configured to store the created stitch pattern data in a storage device that is connected to the sewing machine 1. In that case, the sewing machine 1, in the main processing that is performed in subsequent rounds, can specify, as the selected stitch pattern, the edited stitch pattern that it has stored in the storage device. This makes it possible for the user to use the edited stitch pattern in subsequent rounds of the processing, which makes the editing of the edited stitch patterns more convenient.

(D) The projection device may also be modified as desired, without being limited to the previously described projector 40. The projection device may be removably mounted on the sewing machine 1. The projection device may also be a separate device from the sewing machine 1. The projection device may be configured to be able to change a mounting position. The projection range of the projection device may also be modified as desired. For example, the projection range may also include the entire sewing area. Every time the edit processing is performed, the projector 40 incorporates the content of the editing into the image that is being projected, but the sewing machine 1 is not limited to operating in that manner. For example, the sewing machine 1 may incorporate the content of the editing into the image that is being projected only when a command to incorporate the content of the changes has been received from the user. In a case where the command to start the sewing has been input, the sewing machine 1 may terminate the projecting by the projector 40. In a case where the projector 40 projects the menu image 150 onto the sewing workpiece 100, the projection position, the design of the menu image 150, and the like may be modified as desired.

(E) The programs that contain the instructions for performing the main processing in FIG. 9, the edit processing in FIG. 11 and the second edit processing in FIG. 12 and the pattern data may be stored in a storage device of the sewing machine 1 before the sewing machine 1 (the device that creates the embroidery data) executes the programs. Therefore, the methods by which the programs and the pattern data are acquired, the routes by which they are acquired, and the device in which the programs are stored may each be modify as desired. The pattern data and the programs, which are executed by the processor of the sewing machine 1, may be received from another device through one of a cable and wireless communications, and they may be stored in a storage device such as a flash memory or the like. The other device may be, for example, a PC or a server that is connected through a network.

(F) The individual steps in the main processing in FIG. 9, the edit processing in FIG. 11 and the second edit processing in FIG. 12 are not limited to the example of being performed by the CPU 61, and some or all of the steps may also be performed by another electronic device (for example, an ASIC). The individual steps of the processing described above may also be performed by distributed processing among a plurality of electronic devices (for example, a plurality of CPUs). The order of the individual steps in the main processing can be modified as necessary, and steps can be omitted and added. Furthermore, a case in which an operating system (OS) or the like that is operating in the sewing machine 1 performs some or all of the actual processing, based on commands from the CPU 61 of the sewing machine 1, and the functions of the embodiment that is described above are implemented by that processing, falls within the scope of the present disclosure.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing machine comprising:

a needle bar configured to be mounted with a sewing needle;

a needle bar mechanism configured to move the needle bar up and down;

a moving mechanism configured to move a workpiece to be sewn;

a projector;

an ultrasonic wave transmission source;

an ultrasonic wave detection device;

a processor; and a memory configured to store computer-readable instructions that, when executed by the processor, instruct the processor to perform processes comprising:

specifying, a plurality of times, a position of the ultrasonic wave transmission source on the workpiece, based on ultrasonic waves detected by the ultrasonic wave detection device, setting a first stitch pattern and a sewing position of the first stitch pattern on the workpiece, based on a plurality of specified positions of the ultrasonic wave transmission source acquired by the specifying of the position the plurality of times, the first stitch pattern being a stitch pattern, causing the projector to project an image that shows the first stitch pattern onto the workpiece in the sewing position, creating first stitch pattern data for sewing the first stitch pattern in the sewing position, based on at least the first stitch pattern and the sewing position, and causing, based on the created first stitch pattern data, the moving mechanism to move the workpiece and the needle bar mechanism to move the needle bar up and down.

2. The sewing machine according to claim 1, wherein the moving mechanism includes an embroidery frame moving mechanism configured to move a frame holder, the frame holder being configured to be mounted with an embroidery frame, the embroidery frame being configured to hold the workpiece, and, wherein the causing the moving mechanism to move the workpiece and the needle bar mechanism to move the needle bar up and down includes causing the embroidery frame moving mechanism to move the frame holder, based on the created first stitch pattern data.

3. The sewing machine according to claim 1, wherein the moving mechanism includes a feed dog, a feed mechanism, and a presser foot configured to press down on the workpiece, and the causing the moving mechanism to move the workpiece and the needle bar mechanism to move the needle bar up and down includes causing the feed mechanism to move the feed dog, based on the created first stitch pattern data.

4. The sewing machine according to claim 1, wherein the computer-readable instructions further instruct the processor to perform processes comprising:

acquiring one of a command to amend at least one part of the first stitch pattern and a command to delete at least one part of the first stitch pattern, and performing one of amending the at least one part of the first stitch pattern and deleting the at least one part of the first stitch pattern, in response to the acquiring of the command, based on at least the plurality of specified positions.

5. The sewing machine according to claim 4, wherein the computer-readable instructions further instruct the processor to perform a process of:

causing the projector to project, in the sewing position, an image representing the first stitch pattern, to which one of the amending and the deleting of the at least one part of the first stitch pattern is applied, in response to the performing of one of the amending and the deleting.

6. The sewing machine according to claim 1, wherein the computer-readable instructions further instruct the processor to perform a process of:

setting a type of a stitch to be formed in a closed region, the closed region being bounded by one or more lines included in the first stitch pattern, and wherein the creating of the first stitch pattern data includes creating of the first stitch pattern data based on at least the first stitch pattern, the sewing position, and the type of the stitch to be formed in the closed region.

7. The sewing machine according to claim 1, wherein the computer-readable instructions further instruct the processor to perform a process of:

setting a type of a stitch representing a line included in the first stitch pattern, and wherein the creating of the first stitch pattern data includes creating of the first stitch pattern data based on at least the first stitch pattern, the sewing position, and the type of the stitch representing the line.

8. The sewing machine according to claim 1, wherein the computer-readable instructions further instruct the processor to perform processes comprising:

specifying a second stitch pattern, the second stitch pattern being selected from among a plurality of stitch patterns stored in a storage device, and acquiring second stitch pattern data stored in the storage device, the second stitch pattern data being data for sewing stitches representing the second stitch pattern, wherein the setting of the first stitch pattern and the sewing position includes setting the first stitch pattern and the sewing position in response to the specifying of the second stitch pattern, based on at least the second stitch pattern and the plurality of specified positions, the first stitch pattern including the second stitch pattern, and the creating of the first stitch pattern data includes creating of the first stitch pattern data in response to the specifying of the second stitch pattern, based on at least, the first stitch pattern, the sewing position, and the second stitch pattern data.

9. A non-transitory computer-readable medium storing computer-readable instructions that, when executed, instruct a processor of a sewing machine to perform processes comprising:

specifying, a plurality of times, a position of an ultrasonic wave transmission source of the sewing machine on a workpiece to be sewn, based on ultrasonic waves detected by an ultrasonic wave detection device of the sewing machine.

setting a first stitch pattern and a sewing position of the first stitch pattern on the workpiece, based on a plurality of specified positions of the ultrasonic wave transmission source acquired by the specifying of the position the plurality of times, the first stitch pattern being a stitch pattern, causing a projector of the sewing machine to project an image that shows the first stitch pattern onto the workpiece in the sewing position, creating first stitch pattern data for sewing the first stitch pattern in the sewing position, based on at least the first stitch pattern and the sewing position, and causing, based on the created first stitch pattern data, a moving mechanism of the sewing machine to move the workpiece and a needle bar mechanism of the sewing machine to move the needle bar up and down.

10. The non-transitory computer-readable medium according to claim 9, wherein the computer-readable instructions further instruct the processor to perform processes comprising:

acquiring one of a command to amend at least one part of the first stitch pattern and a command to delete at least one part of the first stitch pattern, and performing one of amending the at least one part of the first stitch pattern and deleting the at least one part of the first stitch pattern, in response to the acquiring of the command, based on at least the plurality of specified positions.

11. The non-transitory computer-readable medium according to claim 10, wherein the computer-readable instructions further instruct the processor to perform a process of:

causing the projector to project, in the sewing position, an image representing the first stitch pattern, to which one of the amending and the deleting of the at least one part of the first stitch pattern is applied, in response to the performing of one of the amending and the deleting.

12. The non-transitory computer-readable medium according to claim 9, wherein the computer-readable instructions further instruct the processor to perform a process of:

setting a type of a stitch to be formed in a closed region, the closed region being bounded by one or more lines included in the first stitch pattern, and wherein the creating of the first stitch pattern data includes creating of the first stitch pattern data based on at least the first stitch pattern, the sewing position, and the type of the stitch to be formed in the closed region.

13. The non-transitory computer-readable medium according to claim 9, wherein the computer-readable instructions further instruct the processor to perform a process of:

setting a type of a stitch representing a line included in the first stitch pattern, and wherein the creating of the first stitch pattern data includes creating of the first stitch pattern data based on at least the first stitch pattern, the sewing position, and the type of the stitch representing the line.

14. The non-transitory computer-readable medium according to claim 9, wherein the computer-readable instructions further instruct the processor to perform processes comprising:

specifying a second stitch pattern, the second stitch pattern being selected from among a plurality of stitch patterns stored in a storage device, and acquiring second stitch pattern data stored in the storage device, the second stitch pattern data being data for sewing stitches representing the second stitch pattern, wherein the setting of the first stitch pattern and the sewing position includes setting the first stitch pattern and the sewing position in response to the specifying of the second stitch pattern, based on at least the second stitch pattern and the plurality of specified positions, the first stitch pattern including the second stitch pattern, and the creating of the first stitch pattern data includes creating of the first stitch pattern data in response to the specifying of the second stitch pattern, based on at least, the first stitch pattern, the sewing position, and the second stitch pattern data.

* * * * *